US008020500B2

(12) United States Patent
Shimizu et al.

(10) Patent No.: US 8,020,500 B2
(45) Date of Patent: Sep. 20, 2011

(54) EMBROIDERABLE SEWING MACHINE

(75) Inventors: Masaki Shimizu, Toyoake (JP); Chikahisa Noguchi, Nagoya (JP); Kentaro Torii, Nagoya (JP); Tomoyasu Niizeki, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 770 days.

(21) Appl. No.: 12/155,943

(22) Filed: Jun. 11, 2008

(65) Prior Publication Data

US 2008/0308026 A1 Dec. 18, 2008

(30) Foreign Application Priority Data

Jun. 13, 2007 (JP) ..... 2007-156155

(51) Int. Cl.
*D05C 7/04* (2006.01)
*D05C 9/04* (2006.01)

(52) U.S. Cl. ..... 112/103; 112/470.06

(58) Field of Classification Search ..... 112/102.5, 112/103, 470.01, 470.06, 475.19; 700/136–138
See application file for complete search history.

(56) References Cited

U.S. PATENT DOCUMENTS 4,763,586 A * 8/1988 Takenoya et al. ..... 112/470.06
5,107,778 A 4/1992 Hisatake et al.
5,291,843 A * 3/1994 Hori ..... 112/103
5,784,986 A 7/1998 Morita
6,568,337 B1 * 5/2003 Durville ..... 112/102.5
6,820,565 B1 11/2004 Kawaguchi et al.
7,258,071 B2 * 8/2007 Shoji ..... 112/103
7,392,755 B2 * 7/2008 Kato et al. ..... 112/102.5
2004/0221780 A1 * 11/2004 Kawaguchi et al. ..... 112/102.5

FOREIGN PATENT DOCUMENTS

| | | |
|---|---|---|
| JP | A-62-72391 | 4/1987 |
| JP | A-62-162286 | 7/1987 |
| JP | A-63-252190 | 10/1988 |
| JP | A-02-045086 | 2/1990 |
| JP | A-03-146758 | 6/1991 |
| JP | A-09-164282 | 6/1997 |
| JP | A-2002-052283 | 2/2002 |
| JP | A-2002-315982 | 10/2002 |
| JP | A-2004-254987 | 9/2004 |

* cited by examiner

*Primary Examiner* — Gary L Welch
*Assistant Examiner* — Nathan Durham
(74) *Attorney, Agent, or Firm* — Oliff & Berridge, PLC

(57) ABSTRACT

An embroiderable sewing machine, including a plurality types of embroidery frames that hold a workpiece cloth to be embroidered; a carriage allowing selective attachment and detachment of the embroidery frames; a transfer mechanism that transfers the carriage independently in two orthogonal directions; a first detector that outputs a constant signal corresponding to the type of embroidery frame attached to the carriage; a second detector capable of outputting a detection signal based on presence and absence of a detection subject provided at the embroidery frame; and a signal converter that converts the constant signal outputted from the first detector into a periodic signal based on the detection signal outputted from the second detector.

5 Claims, 25 Drawing Sheets

TRUTH VALUE OF PULSE SIGNAL GENERATOR

| ENB TERMINAL | OUT TERMINAL |
|---|---|
| L SIGNAL | L SIGNAL |
| H SIGNAL | PULSE SIGNAL (100ms) |

FIG.14

TRUTH VALUE OF SELECTOR

| SEL TERMINAL | OUT TERMINAL |
|---|---|
| L SIGNAL | CONSTANT SIGNAL OF IN1 |
| H SIGNAL | 0V SIGNAL OF IN2 |

FIG.15

79a

FRAME-TYPE DETERMINATION TABLE

| ANALOG VOLTAGE (V) | FRAME-TYPE DETERMINATION SIGNAL | EMBROIDERY FRAME TYPE |
|---|---|---|
| 0.7 | CONSTANT SIGNAL | FRAME TYPE A |
| | PULSE SIGNAL | FRAME TYPE E |
| 1.4 | CONSTANT SIGNAL | FRAME TYPE B |
| | PULSE SIGNAL | FRAME TYPE F |
| 2.1 | CONSTANT SIGNAL | FRAME TYPE C |
| | PULSE SIGNAL | FRAME TYPE G |
| 2.8 | CONSTANT SIGNAL | FRAME TYPE D |
| | PULSE SIGNAL | FRAME TYPE H |

FIG.16

TRUTH VALUE OF HALL IC

| MAGNET | S TERMINAL | N TERMINAL |
|---|---|---|
| NONE | L SIGNAL | L SIGNAL |
| N POLE | L SIGNAL | H SIGNAL |
| S POLE | H SIGNAL | L SIGNAL |

FIG.21

TRUTH VALUE OF PULSE SIGNAL GENERATOR

| ENB TERMINAL | SEL TERMINAL | OUT TERMINAL |
|---|---|---|
| L SIGNAL | L SIGNAL | L SIGNAL |
| H SIGNAL | L SIGNAL | PULSE SIGNAL (100ms) |
| H SIGNAL | H SIGNAL | PULSE SIGNAL (200ms) |

FIG.22

TRUTH VALUE OF SELECTOR

| SEL2 TERMINAL | SEL1 TERMINAL | OUT TERMINAL |
|---|---|---|
| L SIGNAL | L SIGNAL | CONSTANT SIGNAL OF IN1 |
| L SIGNAL | H SIGNAL | 0V SIGNAL OF IN2 |
| H SIGNAL | L SIGNAL | CONSTANT SIGNAL OF IN1 |
| H SIGNAL | H SIGNAL | 3.3V SIGNAL OF IN3 |

FIG.23

FRAME-TYPE DETERMINATION TABLE

| ANALOG VOLTAGE (V) | FRAME-TYPE DETERMINATION SIGNAL | EMBROIDERY FRAME TYPE |
|---|---|---|
| 0.7 | CONSTANT SIGNAL | FRAME TYPE A |
| | PULSE SIGNAL(100ms,0V) | FRAME TYPE E |
| | PULSE SIGNAL(100ms,3.3V) | FRAME TYPE I |
| | PULSE SIGNAL(200ms,0V) | FRAME TYPE M |
| | PULSE SIGNAL(200ms,3.3V) | FRAME TYPE Q |
| 1.4 | CONSTANT SIGNAL | FRAME TYPE B |
| | PULSE SIGNAL(100ms,0V) | FRAME TYPE F |
| | PULSE SIGNAL(100ms,3.3V) | FRAME TYPE J |
| | PULSE SIGNAL(200ms,0V) | FRAME TYPE N |
| | PULSE SIGNAL(200ms,3.3V) | FRAME TYPE R |
| 2.1 | CONSTANT SIGNAL | FRAME TYPE C |
| | PULSE SIGNAL(100ms,0V) | FRAME TYPE G |
| | PULSE SIGNAL(100ms,3.3V) | FRAME TYPE K |
| | PULSE SIGNAL(200ms,0V) | FRAME TYPE O |
| | PULSE SIGNAL(200ms,3.3V) | FRAME TYPE S |
| 2.8 | CONSTANT SIGNAL | FRAME TYPE D |
| | PULSE SIGNAL(100ms,0V) | FRAME TYPE H |
| | PULSE SIGNAL(100ms,3.3V) | FRAME TYPE L |
| | PULSE SIGNAL(200ms,0V) | FRAME TYPE P |
| | PULSE SIGNAL(200ms,3.3V) | FRAME TYPE T |

FIG.24

EMBROIDERABLE SEWING MACHINE

CROSS-REFERENCE TO RELATED APPLICATIONS

This application is based upon and claims the benefit of priority from the prior Japanese Patent Applications 2007-156155, filed on, Jun. 13, 2007, the entire contents of which are incorporated herein by reference.

FIELD

The present disclosure relates to an embroiderable sewing machine that forms embroidery patterns by transferring a carriage, allowing attachment and detachment of an embroidery frame, in two orthogonal directions, and more particularly to an embroiderable sewing machine allowing selective and interchangeable attachment of the embroidery frame from a choice of various frame types.

BACKGROUND

An embroiderable sewing machine is equipped with different types of embroidery frames having various sizes of sewable areas. The user is allowed to select an embroidery frame having a sewable area most suitable for the embroidery pattern to be sewn from the given embroidery frames and attach the selected embroidery frame to an embroidery unit of the sewing machine. Such configuration requires the sewing machine to detect the size of the embroidery frame attached in order to control embroidering of the desired embroidery pattern.

Digital and analog detection systems are generally known for frame-type detection of the embroidery frame attached to the sewing machine.

Under the digital system, the embroidery frame is provided with bumps that are arranged in a combination specific to each embroidery frame, whereas the embroidery unit is provided with a plurality of detections switches constituting a detection sensor allowing detection of the bumps. Under such configuration, the type of embroidery frame attached to the embroidery unit is detected by the combination of the detection signals outputted from each of the detection switches.

Under the analog system, the embroidery frame is provided with bumps, whereas the embroidery unit is provided with a voltage output element that outputs voltage signals of various magnitudes depending on the bumps detected. Under such configuration, the type of embroidery frame attached to the embroidery unit is detected by the magnitude of voltage signal outputted by the voltage output element.

For instance, an embroidery sewing machine described in pages 3 and FIGS. 1 and 5 of JP 2004-254987 A is provided with an X-directional carriage movable in the X-direction and having holder body connected to it. The holder body has left and right arms, the right arm being secured to the right end of the holder body and the left arm provided slidably on the left end of the holder body to serve as a movable holder. Further, the movable holder has a detection subject attached to its underside. The detection subject comprises a plurality of detection subject sections aligned in series along the lengthwise direction of the movable holder to exhibit a generally stepped configuration. The holder body is provided with a detector comprising a potentiometer that outputs voltage signals associated with the height of the detection subject sections.

When the user secures the embroidery frame to be used on the lateral arms of the holder body after laterally positioning the movable holder suitable for the size of the embroidery frame, a detection arm of the detector is rotated depending on the height of the detection subject section. Based on the voltage signal outputted from the detector depending on the height of the detection subject section, a controller provided on the sewing machine detects the type of embroidery frame attached to the carriage.

The latest sewing machines of this type have increasing number of frame types to facilitate embroidering of various embroidery patterns. The embroidery sewing machine described in the above described publication detects the embroidery frame type based on the size of the voltage signal outputted from the detector depending on the height of the detection subject section on which the detection arm contacts when the movable holder having the stepped detection subject is moved depending on the embroidery frame attached. In order to accurately distinguish the embroidery frame type by the difference in the voltage signal outputted from the detector, the voltage signals need to be outputted at predetermined intervals. In other words, the difference in height of the neighboring detection subject sections must take a predetermined amount or greater. Furthermore, maximum rotation amount of the detection arm of the potentiometer serving as the detector is approximately 180 degrees. The above described limitations of the embroidery sewing machine disclosed in the referenced publication only allows distinction of about 5 embroidery frame types, and thus cannot distinguish large number of frame types in the magnitude of 10 to 15 types, for example.

Contrastingly, under the digital system where embroidery frame types are detected by the combination of detection signals outputted from each of the detection switches, number of detection switches may be increased as the number of embroidery frame types are increased. However, such arrangement requires the additional space for providing the detections switches.

SUMMARY

An object of the present disclosure is to accurately and readily determine the frame type of the embroidery frame attached to the carriage from increased number of frame types.

An embroiderable sewing machine of the present disclosure includes a plurality types of embroidery frames that hold a workpiece cloth to be embroidered; a carriage allowing selective attachment and detachment of the embroidery frames; a transfer mechanism that transfers the carriage independently in two orthogonal directions; a first detector that outputs a constant signal corresponding to the type of embroidery frame attached to the carriage; a second detector capable of outputting a detection signal based on presence and absence of a detection subject provided at the embroidery frame; and a signal converter that converts the constant signal outputted from the first detector into a periodic signal based on the detection signal outputted from the second detector.

According to the above described configuration, when the embroidery frame is attached to the carriage, the first detector outputs the constant signal having an analog voltage corresponding to the frame type of the embroidery frame and the second detector outputs the detection signal corresponding to the presence and absence of the detection subject provided on the embroidery frame attached to the carriage. The signal converter converts the constant signal outputted from the first detector into a periodic signal based on the detection signal outputted from the second detector. Thus, the above described configuration allows considerable increase in the number of detectable embroidery frame types since the embroidery frame type can be determined based on the levels of constant signals outputted from the signal converter as done conventionally and also by the periods of the periodic signals since the signal converter outputs periodic signals.

BRIEF DESCRIPTION OF THE DRAWINGS

Other objects, features and advantages of the present disclosure will become clear upon reviewing the following description of the illustrative aspects with reference to the accompanying drawings, in which.

FIG. 14 is a diagram describing truth values of a pulse signal generator;

FIG. 15 is a diagram describing truth values of a selector;

FIG. 16 is a diagram describing settings of a frame-type determination table;

FIG. 21 is a diagram describing truth values of the Hall IC;

FIG. 22 is a diagram describing truth values of the pulse signal generator;

FIG. 23 is a diagram describing truth values of the selector;

FIG. 24 is a diagram describing settings of the frame-type determination table;

DETAILED DESCRIPTION

A first exemplary embodiment of the present disclosure will be described hereinafter with reference to FIGS. 1 to 19.

Figure 1:
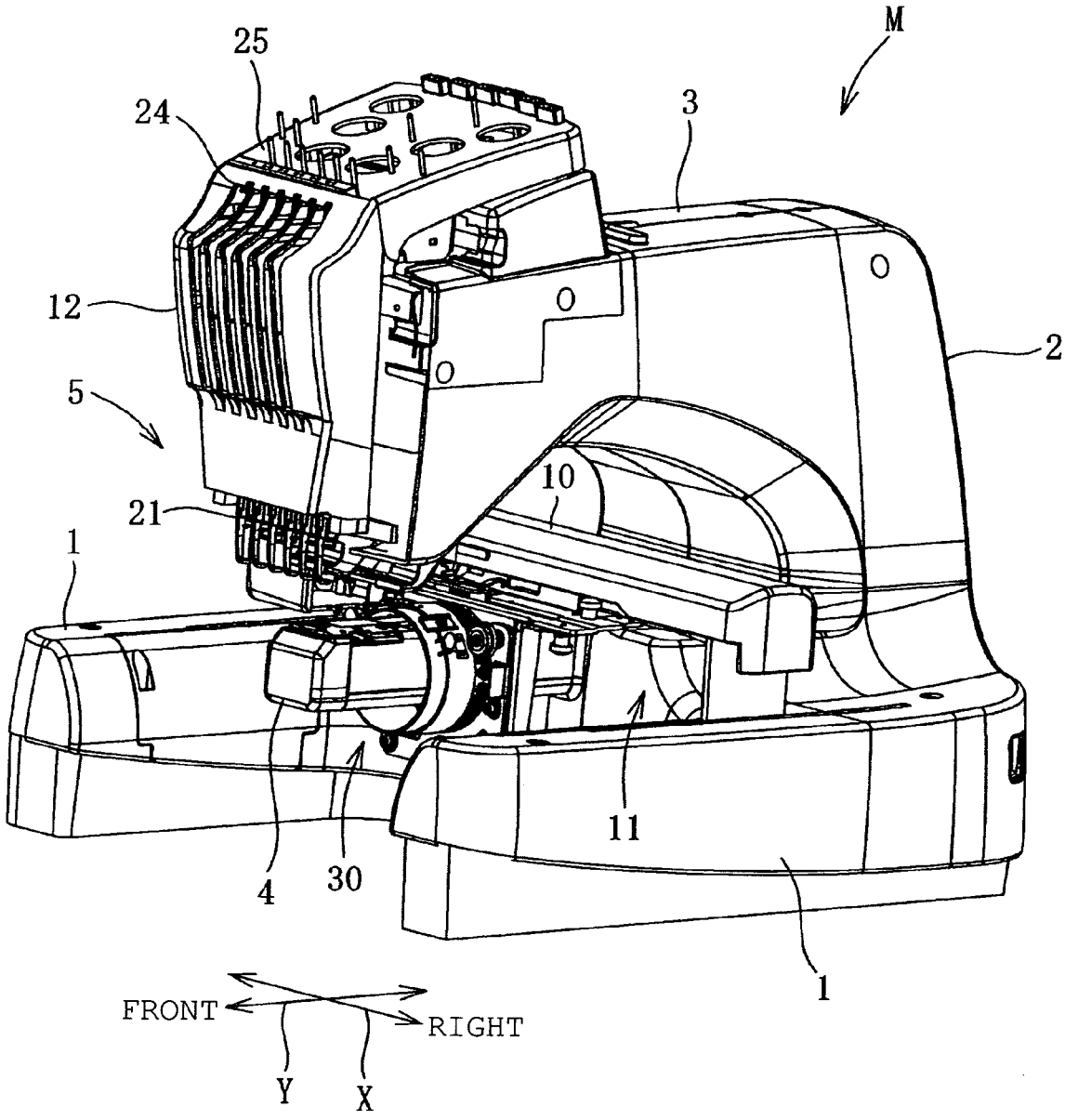
FIG. 1 is a perspective view of an embroiderable sewing machine according to a first exemplary embodiment of the present disclosure.

An embroiderable sewing machine of the present exemplary embodiment is exemplified as a multi-needle embroidery sewing machine. Referring to FIG. 1, a multi-needle sewing machine M (hereinafter simply referred to as embroidery sewing machine M) includes a pair of left and right feet 1 supporting the entire sewing machine, a pillar 2 standing at the rear ends of the feet 1, an arm 3 extending forward from the upper end of pillar 2, a cylinder bed 4 extending horizontally forward from the lateral center of feet 1, and an embroidery sewing mechanism 5.

Embroidery sewing mechanism 5 includes components such as a carriage 10 allowing selective attachment of plurality types of embroidery frames later described in detail, a carriage transfer mechanism 11 that transfers carriage 10 independently in two orthogonal directions, a needle-bar case 12, and a frame-type detection mechanism 13 (refer to FIG. 4) that detects the type of embroidery frame attached to carriage 10.

Referring to FIG. 1, carriage 10 being oriented laterally is placed above the left and right pair of feet 1 as shown in FIG. 1. The front side of carriage 10 allows mounting of a cylindrical frame unit 30 later described in detail. Carriage 10 contains a carriage frame (not shown) that has a Y-directional carriage 15 (refer to FIG. 5) secured to it. The left and right feet 1 contain a Y-directional drive mechanism (not shown) driven by a Y-axis drive motor 17 (refer to FIG. 13).

Carriage 10, driven by Y-axis drive motor 17 is transferred in the Y-direction (longitudinal direction) via the Y-directional drive mechanism. Thus, Y-directional carriage 15 secured to the carriage frame is transferred integrally in the Y-direction with the Y-directional transfer of carriage 10. Carriage 10 also contains an X-directional carriage 16 (refer to FIG. 2) supported movably in the X-direction (lateral direction) by the carriage frame and an X-directional drive mechanism (not shown) for transferring X-directional carriage 16 in the X-direction by an X-directional drive motor 18 (refer to FIG. 13).

X-directional carriage 16, driven by X-axis drive motor 18 is transferred in the X-direction (lateral direction) via the X-directional drive mechanism. Mechanisms such as X-directional and Y-directional drive mechanisms constitute a carriage transfer mechanism 11.

Next, a description will be given on needle-bar case 12.

Figure 13:
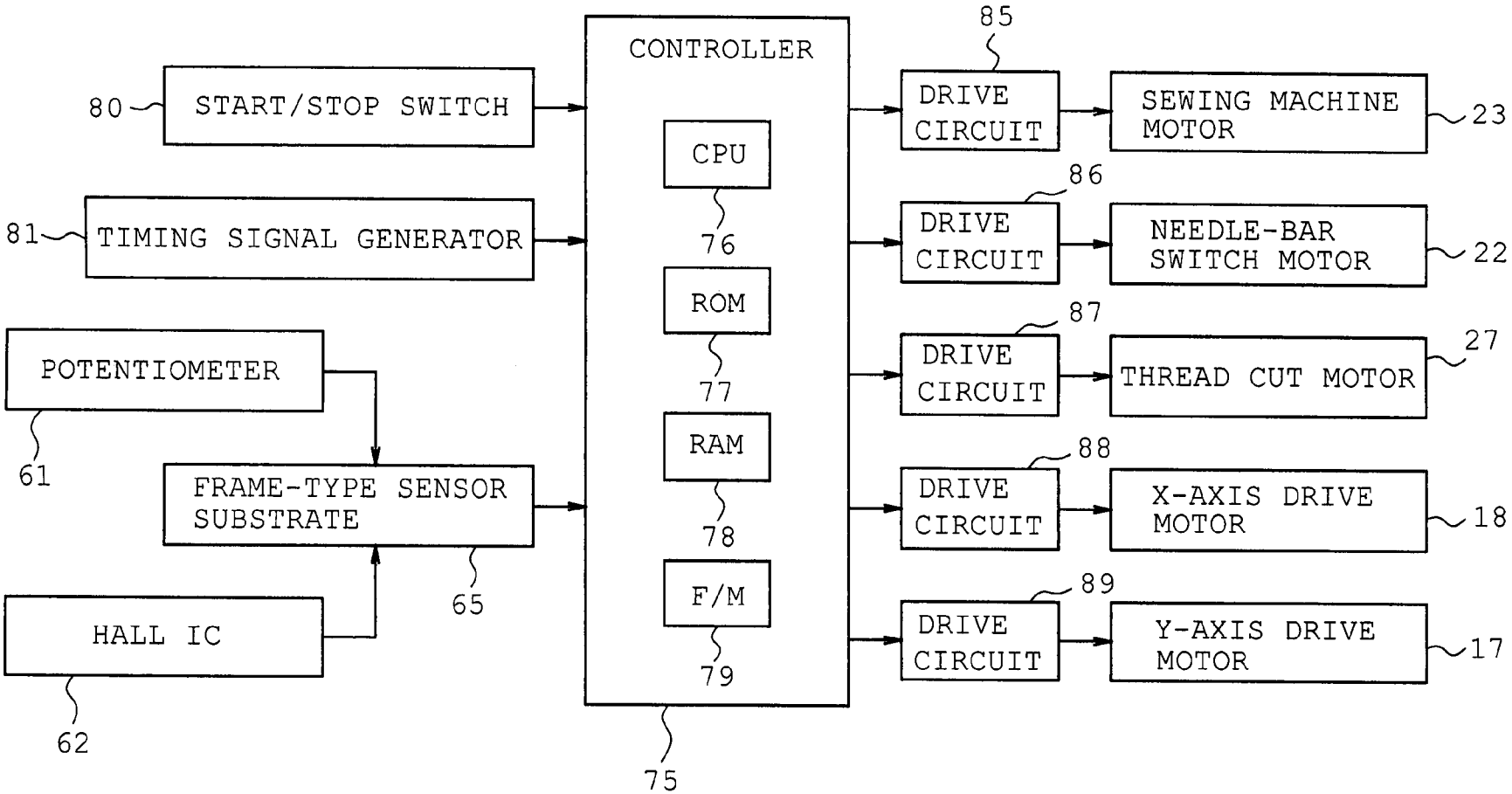
FIG. 13 is a block diagram of a control system for a multi-needle embroiderable sewing machine.

Needle-bar case 12 is provided with six needle bars 21 having sewing needles (not shown) attached on their lower ends and a needle-bar selection mechanism (not shown) having a needle-bar switch motor 22 (refer to FIG. 13). Needle-bar case 12, being driven by needle-bar switch motor 22 is laterally moved via the needle-bar selection mechanism to select one out of six needle bars 21. The selected needle-bar 21 and the sewing needle attached to its lower end are vertically driven integrally via needle-bar drive mechanism (not shown) by a sewing machine motor 23 (refer to FIG. 13) provided inside pillar 2.

Needle-bar case 12 has six thread take-ups 24 laterally aligned in a row attached to it. Each thread-take up 24 is associated with each needle bar 21. Needle-bar case 12 has secured on its upper end a thread tension frame 25 made of synthetic resin that is slightly upwardly inclined towards the rear. Cylinder bed 4 contains components such as a thread loop taker (not shown) and a thread cutter (not shown) in its front end interior. The thread cutter has a movable blade, driven in a reciprocating manner by a thread cut motor 27 (refer to FIG. 13) to cut the needle thread and the bobbin thread.

Next, a description will be given on the cylindrical frame unit 30 which is used for embroidering cylindrical workpiece.

Figure 2:
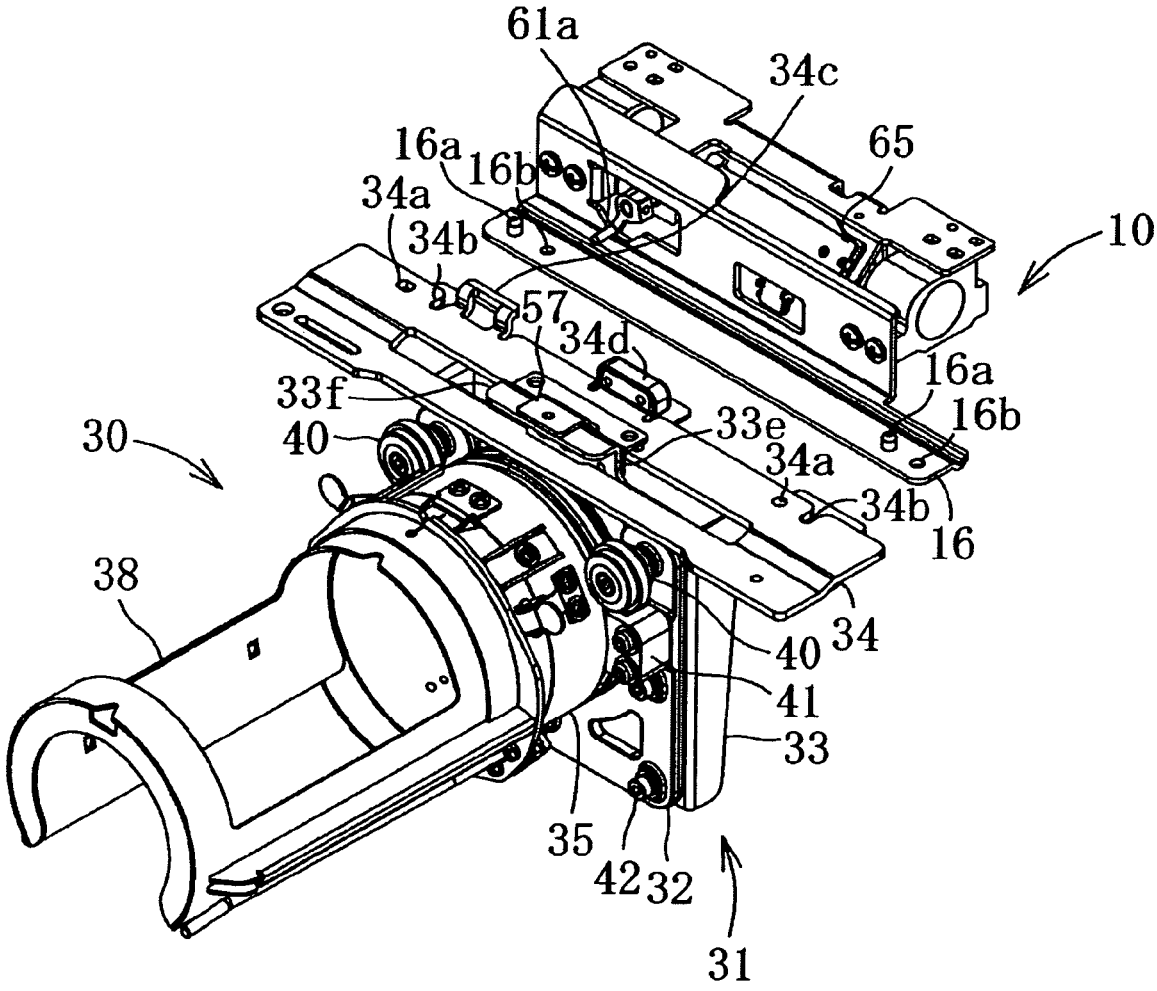
FIG. 2 is a perspective view of a cylindrical frame unit.
Figure 3:
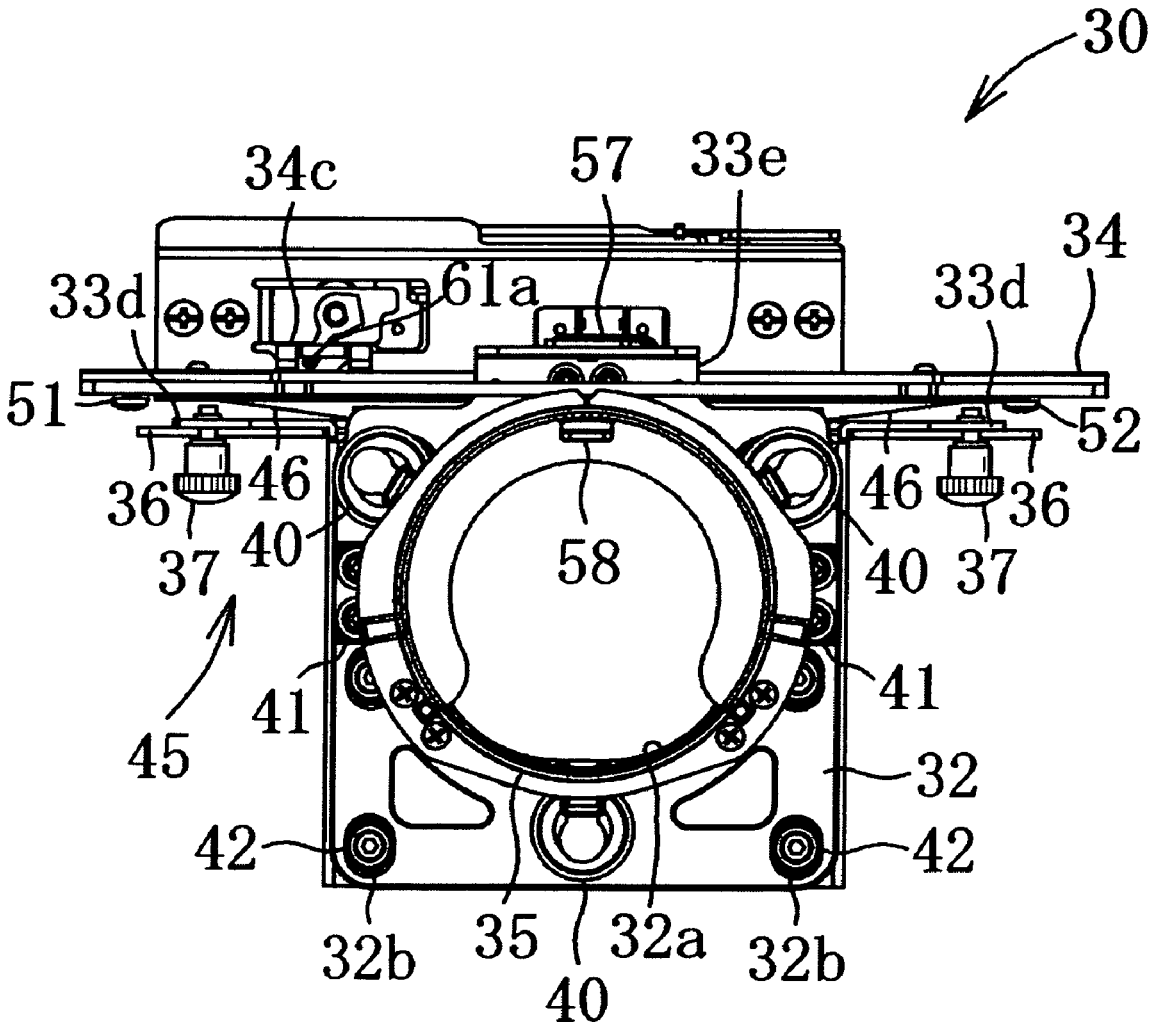
FIG. 3 is a front view of a cylindrical frame unit.
Figure 4:
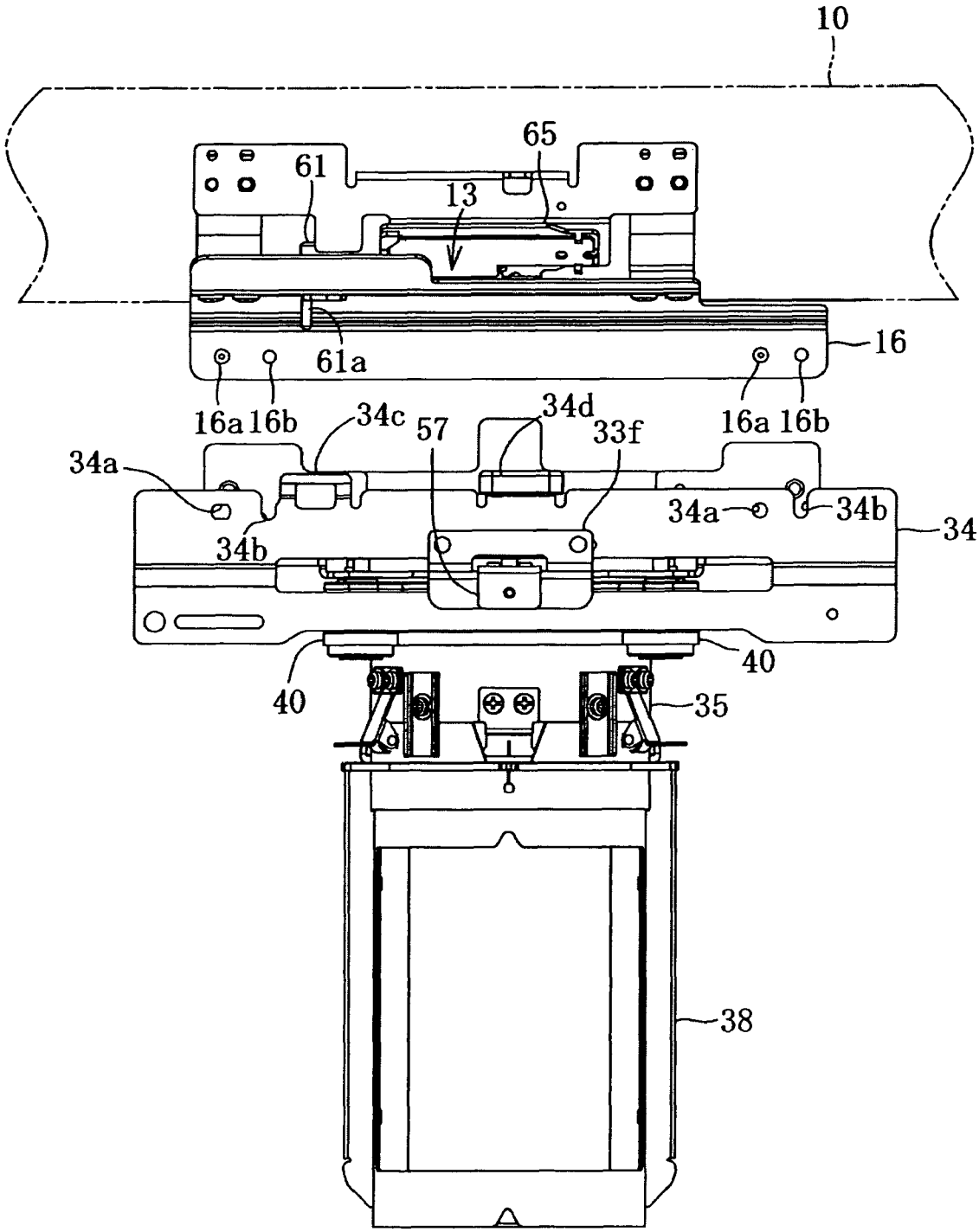
FIG. 4 is a plan view of a cylindrical frame unit.

Referring to FIGS. 1 to 3, the cylindrical frame unit 30 includes a body frame 31 connected to Y-directional carriage 15, a rotary frame 35 pivoted on body frame 31, a rotary mechanism 45 connected to X-directional carriage 16 and that rotates rotary frame 35, a position regulator 58 that establishes sliding contact with the upper surface of cylinder bed 4, a mount 57 that allows mounting of position regulator 58 on body frame 31, a cylindrical frame 38 attachably/detachably attached to rotary frame 35. FIG. 2 illustrates rotary frame 35 before attachment of cylindrical frame 45.

First, a description will be given on body frame 31 connected to Y-directional and X-directional carriages 15 and 16, and rotary frame 35 connected to body frame 31.

Body frame 31 includes a base frame 32 of a predetermined thickness and a connection frame 33 secured to base frame 32 and connected to Y-directional carriage 15.

Base frame 32 has a substantially circular notch 32*a* allowing passage of cylinder bed 4. Three sets of rollers 40 that rotatably support rotary frame 35 are pivoted on base frame 32. Base frame 22 is further provided with a pair of left and right regulatory blocks 41 for regulating the longitudinal positioning of rotary frame 35.

Referring to FIGS. 2 to 5, connection frame 33 has a mount wall (not shown), bends 33*c* defined by rewardly bending the left and right ends of the mount wall, a pair of left and right Y-directional connections 33*d* defined by bending the upper ends of bends 33*c* horizontally outward. The Y-directional carriage 15 has a left and right pair of Y-directional connection plates 36 (refer to FIG. 3) that allow the pair of left and right Y-directional connections 33*d* to be detachably/attachably attached to them by finger bolts 37. Body frame 31, thus establishes connection with Y-directional carriage 15 to effect Y-directional movement along with Y-directional carriage 15.

Base frame 32 is secured on mount wall of connection frame 33 by four fastener bolts 42 so as to be adjustable in height. More specifically, base frame 32 has vertically-elongate bolt insertion holes 32*b* for insertion of fastener bolts 42. Thus, when fastener bolts 42 are loosened, the vertical positioning of base frame 32 can be adjusted relative to connection frame 33, in other words, adjustment can be made on the vertical positioning of rotary frame 35 relative to connection frame 33.

Figure 5:
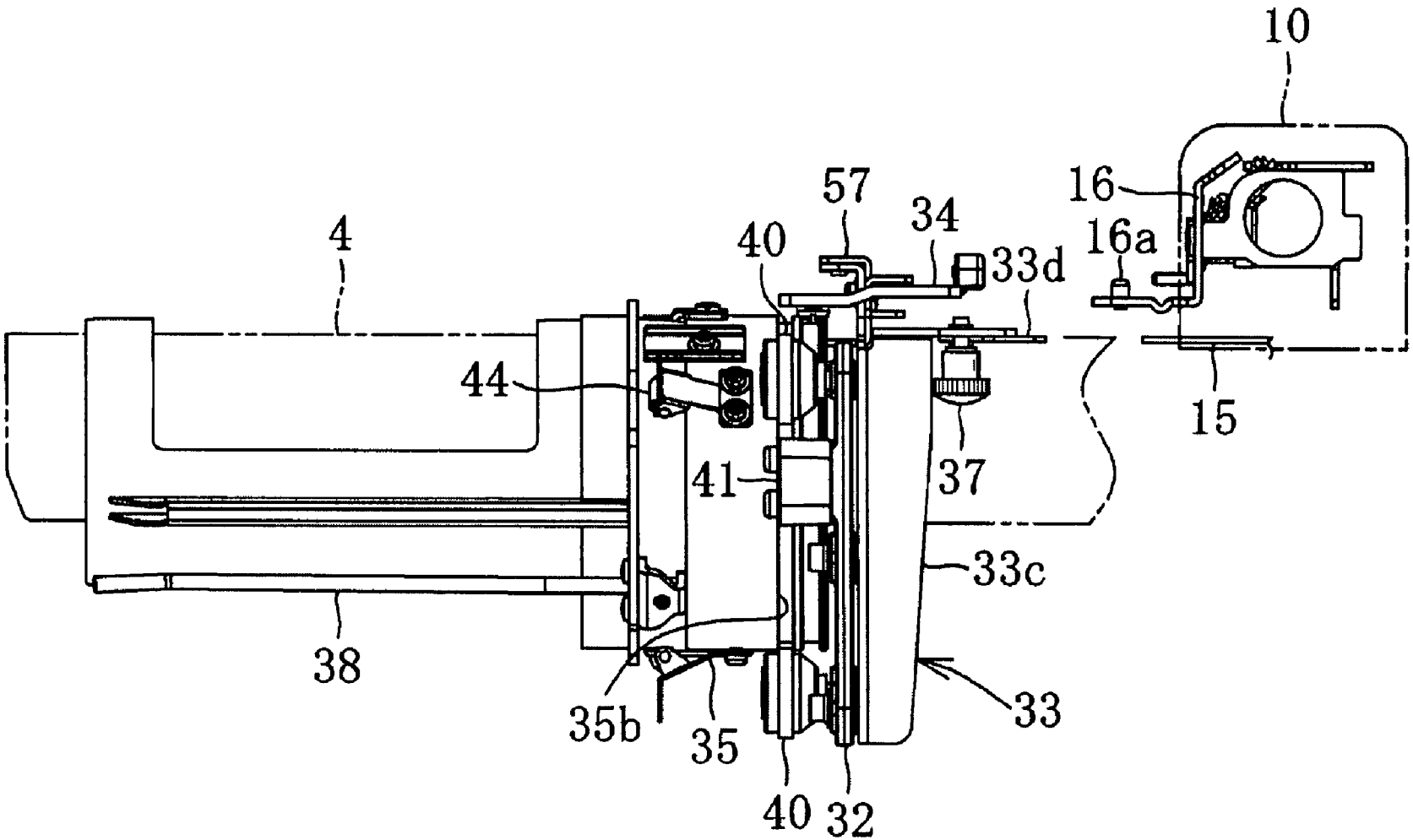
FIG. 5 is a side view of a cylindrical frame unit.

Referring to FIGS. 2 and 5, rotary frame 35 is rotatably supported by body frame 31 via three sets of rollers 40. Rotary frame 35 is made of synthetic resin material and is generally cylindrical. Rotary frame 35 has a cylindrical frame attachment (not shown) formed in its front end for attachable/detachable attachment of a cylindrical frame 38. The outer periphery of cylindrical frame attachment is provided with a set of engagement rollers 44. Engagement rollers 44 establish engagement with engagement holes provided on cylindrical frame 38 when cylindrical frame 38 is fitted over the front-end side section of rotary frame 35 to connect cylindrical frame 38 integrally with rotary frame 35.

The rear-end outer periphery of rotary frame 35 has an annular wire guide groove (not shown) for guidance of wire 46. On the outer peripheral surface of rotary frame 35 in front of the wire guide groove, an annular roller groove 35*b* (refer to FIG. 5) is defined for engagement of the 3 sets of rollers 40 and the pair of left and right regulatory blocks 41.

Next, a description will be given on rotary mechanism 45

Referring to FIGS. 2 and 5, rotary mechanism 45 includes a laterally elongate movable element 34 connected to X-directional carriage 16, a wire 46 wound on the wire guide groove of rotary frame 35 and having both of its ends connected to the two lateral ends of movable element 34.

Movable element 34 has a couple of through holes 34*a* and cuts 34*b* defined at its left and right rear ends, respectively; whereas X-directional carriage 16 has positioning pins 16*a* at positions corresponding to the couple of through holes 34*a* and screw holes 16*b* at positions corresponding to the couple of cuts 34*b*. When mounting movable element 34 on X-directional carriage 16, through holes 34*a* are located with positioning pins 16*a*. Cuts 34*b* consequently being located with screw holes 16*b* allows movable element 34 to be secured on X-directional carriage 16 by finger bolts (not shown). Movable element 34 is thus connected to X-directional carriage 16.

Movable element 34 has a laterally-repositionable wire connector (not shown) secured on its left end upper side by a screw (not shown). At the underside of movable element 34, one end of wire 46, leftwardly extending from rotary frame 35, is connected to the wire connector underside by a screw 51. Similarly the other end of wire 46, rightwardly extending from rotary frame 35, is secured to the right end underside of movable element 34 by a screw 52.

The tension of wire 46 can be adjusted by adjustment of the lateral positioning of wire connector relative to movable element 34. At the lengthwise mid portion of wire 46, a globule (not shown) is secured by caulking. The globule is engaged with an engagement hole (not shown) defined on the wire guide groove of rotary frame 35. Thus, the movement of wire 46 unslippably wound on rotary frame 35 causes rotation of rotary frame 35.

When X-directional carriage 16 is laterally moved, movable element 34 is laterally moved integrally with X-directional carriage 16. At this instance, since the ends of wire 46 connected to the lateral sides of movable element 34 are also moved, rotary frame 35 is moved clockwise or counterclockwise in front view. Thus, rotary mechanism 45 serves as a conveyor that converts lateral motion of X-directional carriage 16 into rotary motion of rotary frame 35.

Referring to FIGS. 2 to 5, the mount wall of connection frame 33 has a notch (not shown) formed on it. Above the notch, a projection 33*e* is formed that extends upward by a predetermined length. On the upper end of projection 33*e*, a horizontal bend 33*f* is formed that is bent horizontally forward. On the rear-side lateral center of projection 33*e*, a mount 57 is provided so as to be vertically movable, mount 57 taking a laterally oriented U-shape in side view. The lower end of mount 57 is bent forward to define a lower wall. The lower wall has a position regulator 58 (refer to FIG. 3) mounted on it, position regulator 58 resembling a block in shape. The underside of position regulator 58 abuts the upper surface of cylinder bed 4.

Embroidery sewing machine M is equipped with various types of embroidery frames attachable to carriage 10. Such embroidery frames include various types of flat frames (not shown) in addition to various types of cylindrical frames 38. Frame-type detection mechanism 13 detects the frame types of cylindrical frames 38 and flat frames attached to carriage 10. The description given hereinafter is based on the detection of frame types of cylindrical frames 38 for simplicity.

Frame-type detection mechanism 13 includes an engagement catch 34*c* provided on movable element 34, a potentiometer 61 (refer to FIG. 13), a frame-type sensor substrate 65 having a Hall IC 62 connected to it, and a cylindrical magnet 63 that renders Hall IC 62 to operate as a switch.

Engagement catch 34*c*, as shown in FIGS. 2 to 4, and 6, is formed in reverse L-shape at the left half rear-end of movable element 34 so as to be elevated higher than the upper surface of movable element 34 and further rearward than the rear end of movable element 34. Some types of movable elements 34 may not have engagement catch 34*c* formed on them. X-directional carriage 16, on the other hand, has a rotary potentiometer 61 at a position corresponding to engagement catch 34*c* on its left half portion. Potentiometer 61 has a shaft provided with a detector 61*a* extending forward like an arm to establish engagement with movable element 34.

When viewed from the front side, detector 61*a* is biased clockwise about the shaft by a torsion spring not shown mounted on potentiometer 61. When detector 61*a* rotates counterclockwise about the shaft, the resistance of a variable resistor equipped to potentiometer 61 is changed. The change in resistance or change in voltage caused by the change in resistance is outputted to controller 75 in the form of a constant signal via frame-type sensor substrate 65 described in detail afterwards. Detector 61*a* is arranged to stop its clockwise rotation at its initial position where resistance is minimum (i.e., 0Ω) by a stopper pin not shown.

Figure 6:
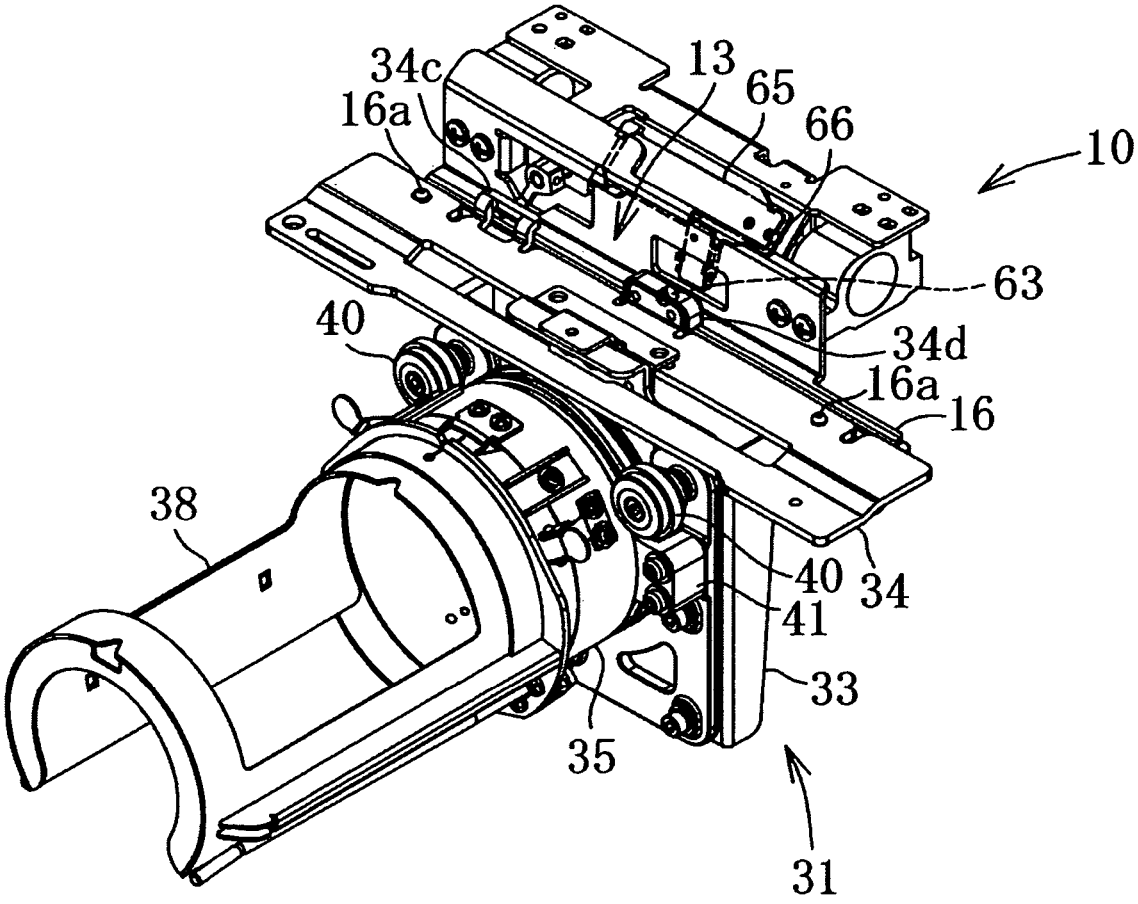
FIG. 6 corresponds to FIG. 2 further illustrating the attachment to carriage.
Figure 9:
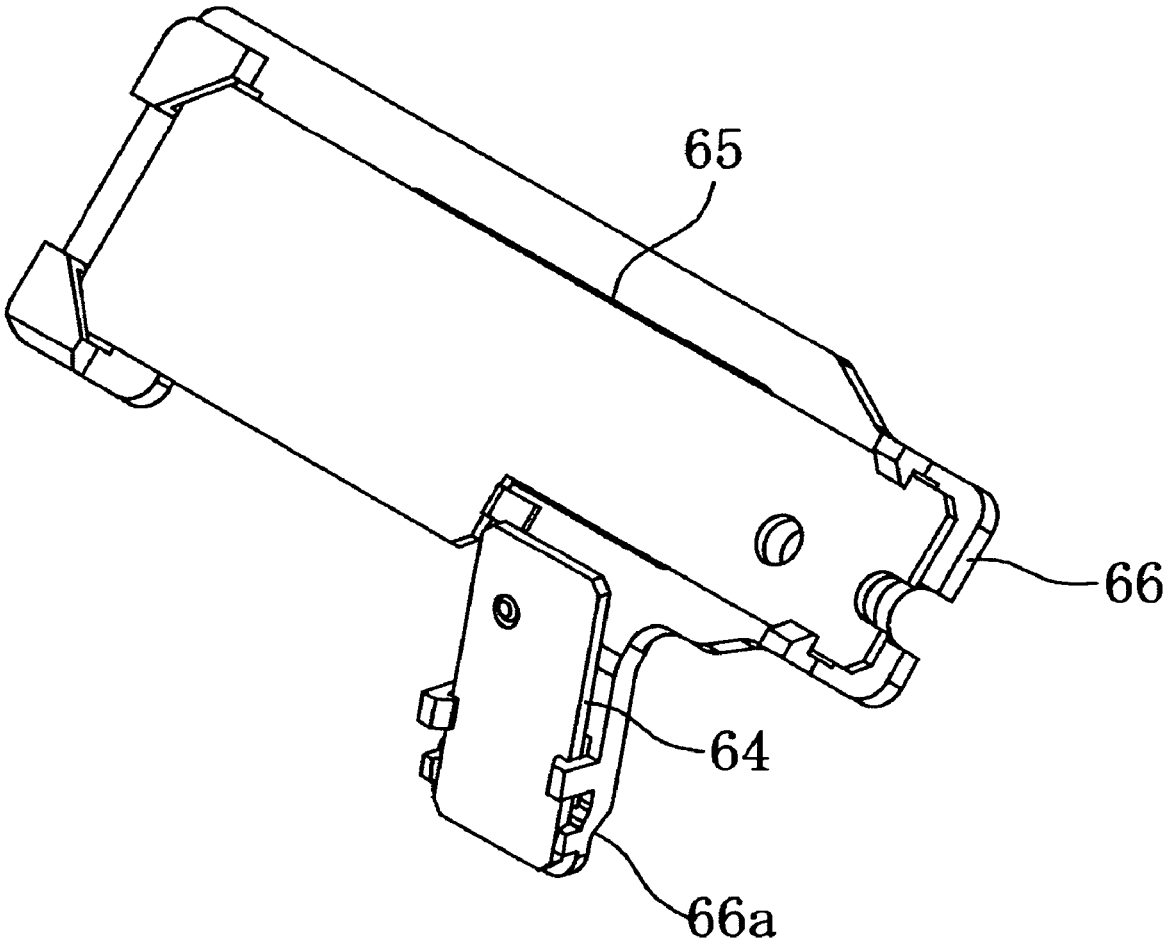
FIG. 9 is a perspective view of a substrate support provided with a compact substrate having a Hall IC and a frame-type sensor substrate.
Figure 10:
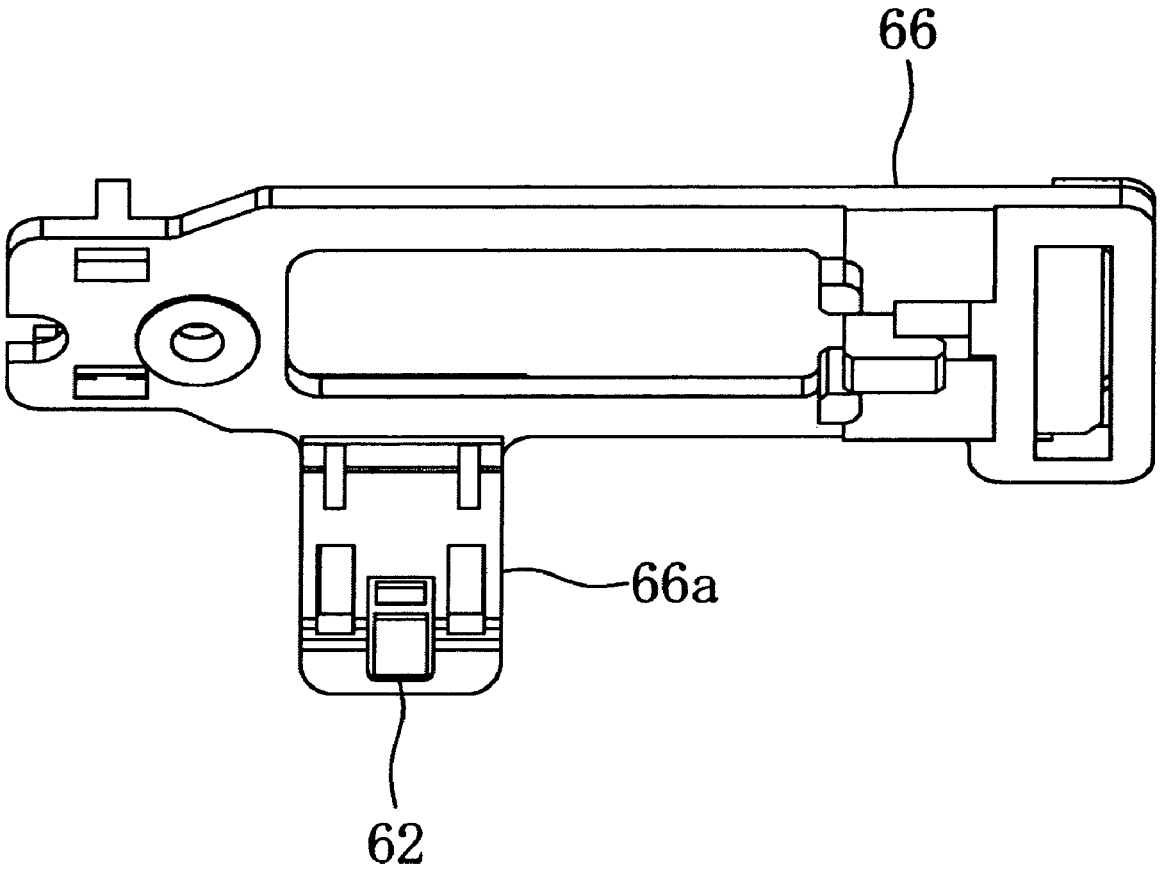
FIG. 10 is a rear view of the substrate support provided with a compact substrate having a Hall IC and a frame-type sensor substrate.

At the rear end of the substantial lateral center of movable element 34, a cylindrical magnet 63 is retained by a retainer 34*d* so that its length direction is oriented longitudinally. The N-pole of magnet 63 is oriented rearward. As shown in FIGS. 6, 9, and 10, X-directional carriage 16 is provided integrally with a substrate support 66. Substrate support 66 is provided with frame-type sensor substrate 65 described in detail afterwards. X-directional carriage 16 has a compact substrate 64 provided with Hall IC 62 in its right half portion, more specifically on a protruding wall 66*a* of substrate support 66 disposed in a location corresponding to retainer 34*d*.

Figure 7:
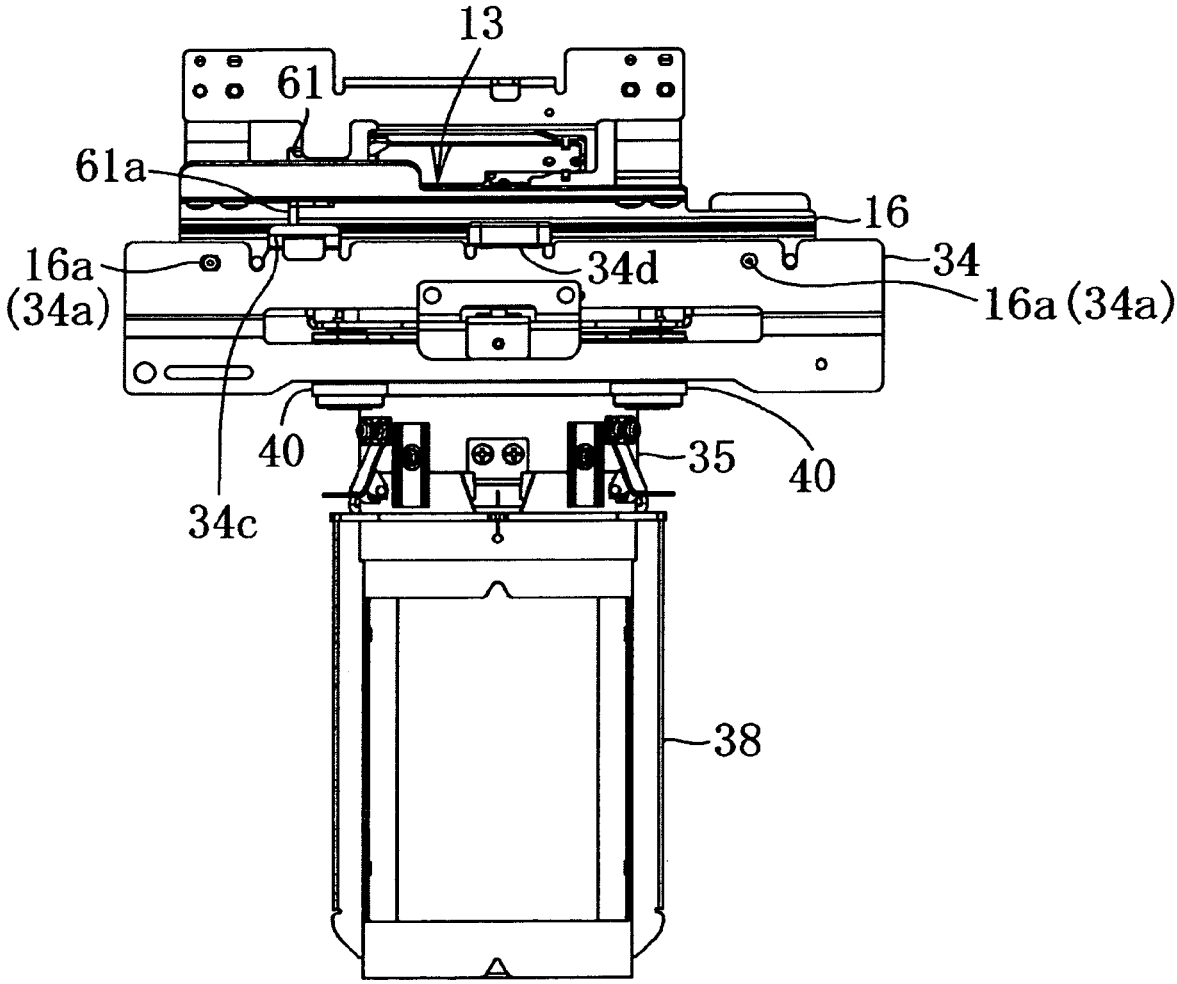
FIG. 7 corresponds to FIG. 4 further illustrating the attachment to carriage.
Figure 8:
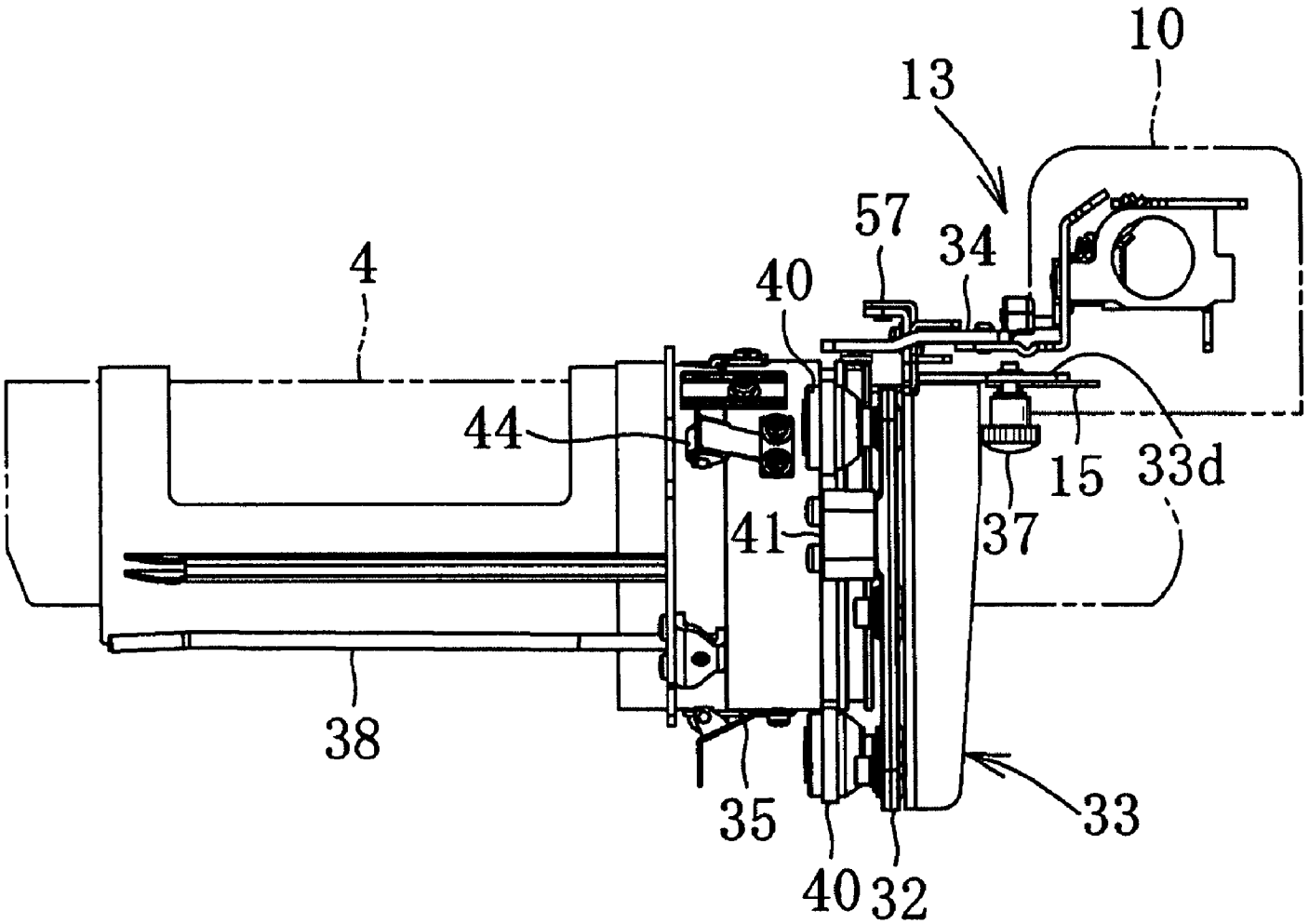
FIG. 8 corresponds to FIG. 5 further illustrating the attachment to carriage.

Referring to FIGS. 6 to 8, cylindrical frame unit 30 is attached to carriage 10 by engaging through hole 34*a* with positioning pin 16*a* and thereafter connecting movable element 34 to X-directional carriage 16 by the finger bolts as described earlier.

Thought not shown, in case cylindrical frame 38 is either "frame type A" or "frame type E", in other words, in case no engagement catch 34*c* is formed on movable element 34, detector 61*a* remains unmoved in a standard position (initial position), potentiometer 61 outputs voltage of approximately 0.7V, for example.

Of note is that, movable element 34 of cylindrical frame unit 30 with attachment of cylindrical frame 38 of "Frame type A" has no magnet 63 embedded in it. On the other hand, movable element 34 of cylindrical frame unit 30 with attachment of cylindrical frame 38 of "Frame type E" has magnet 63 embedded in it.

Figure 11A:
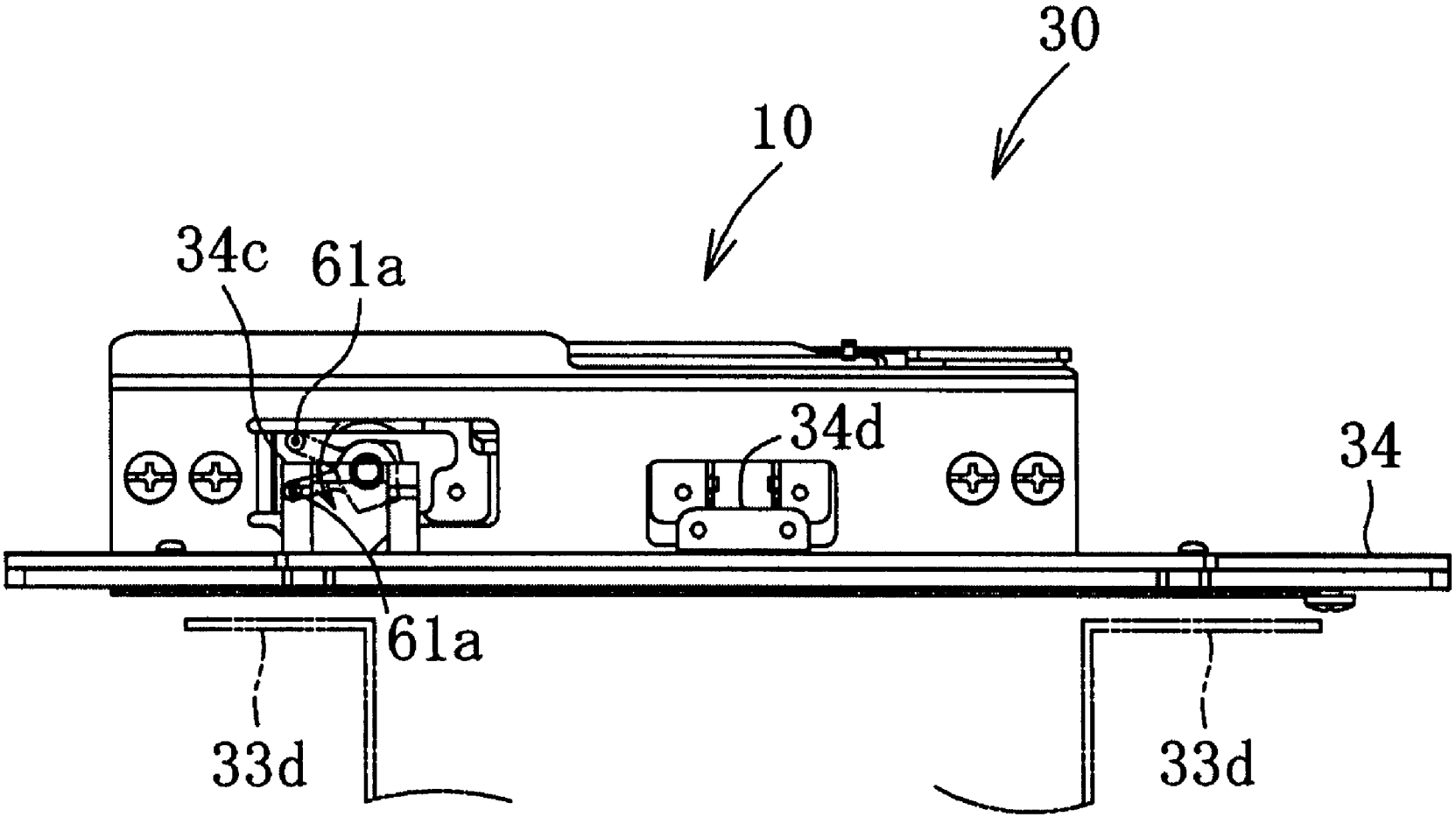
FIG. 11A is a partially enlarged front view of FIG. 3.

Referring to FIG. 11A, in case cylindrical frame 38 is "frame type B" or "frame type F", engagement catch 34*c* shows considerable elevation from movable element 34*c*. Since detector 61*a* rotated by engagement catch 34*c* takes a small rotational angle relative to the standard position indicated by double-dot chain line, potentiometer 61 outputs voltage of approximately 1.4V, for example.

Of note is that, movable element 34 of cylindrical frame unit 30 with attachment of cylindrical frame 38 of "Frame type B" has no magnet 63 embedded in it, though it is provided with retainer 34*d*. On the other hand, movable element 34 of cylindrical frame unit 30 with attachment of cylindrical frame 38 of "Frame type F", having engagement catch 34*c* of the same elevation as "frame type B", has magnet 63 embedded inside retainer 34*d*.

Figure 11B:
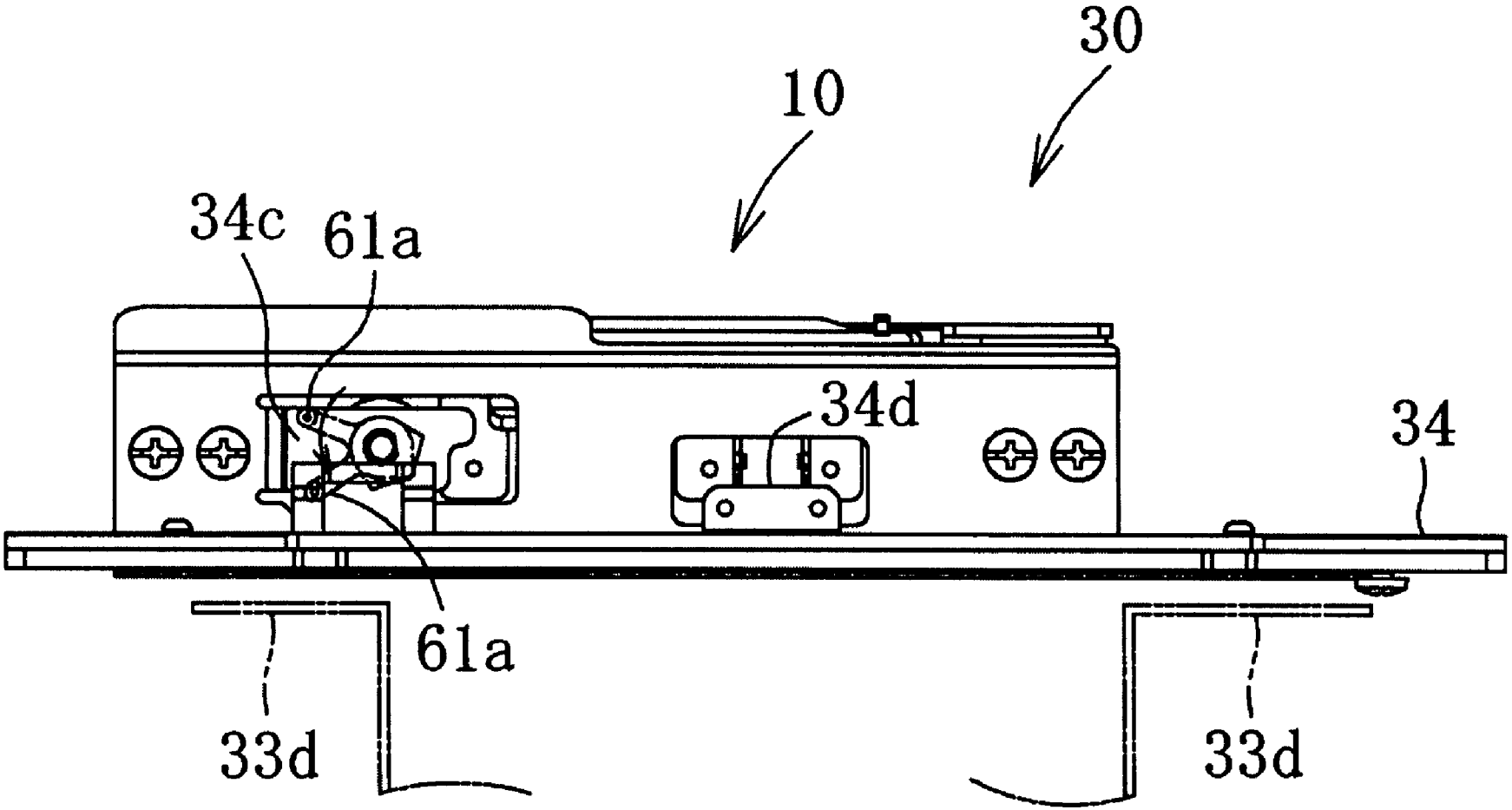
FIG. 11B is a partially enlarged front view of FIG. 3.

Referring to FIG. 11B, in case cylindrical frame 38 is "frame type C" or "frame type G", the elevation of engagement catch 34*c* is slightly lower compared to previous frame types. Since detector 61*a* rotated by engagement catch 34*c* takes greater rotational angle relative to the standard position compared to the previous frame types, potentiometer 61 outputs voltage of approximately 2.1 V, for example. Of note is that, though movable element 34 of cylindrical frame unit 30 with attachment of cylindrical frame 38 of "Frame type C" is provided with retainer 34*d*, it has no magnet 63 embedded in it. On the other hand, movable element 34 of cylindrical frame unit 30 with attachment of cylindrical frame 38 of "Frame type G" has magnet 63 embedded inside retainer 34*d*.

Figure 11C:
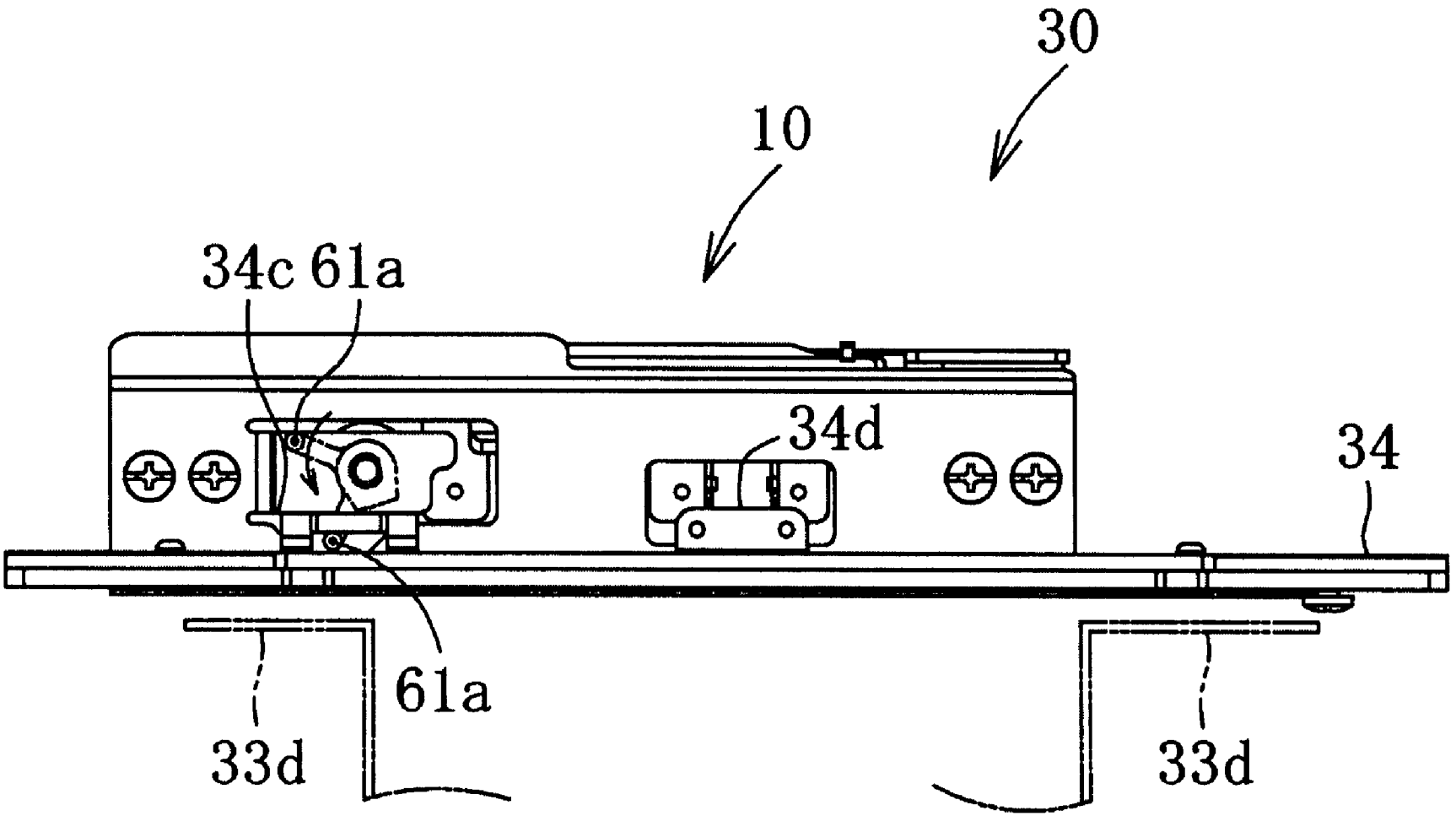
FIG. 11C is a partially enlarged front view of FIG. 3.

Referring to FIG. 11C, in case cylindrical frame 38 is "frame type D" or "frame type H", the elevation of engagement catch 34*c* is considerably lower compared to previous frame types. Since detector 61*a* rotated by engagement catch 34*c* takes greater rotational angle relative to the standard position compared to the previous frame types, potentiometer 61 outputs voltage of approximately 2.8 V, for example. Of note is that, though movable element 34 of cylindrical frame unit 30 with attachment of cylindrical frame 38 of "frame type D" is provided with retainer 34*d*, it has no magnet 63 embedded in it. On the other hand, movable element 34 of cylindrical frame unit 30 with attachment of cylindrical frame 38 of "frame type H" has magnet 63 embedded inside retainer 34*d*.

Next, a description will be given on frame-type sensor substrate 65.

Figure 12:
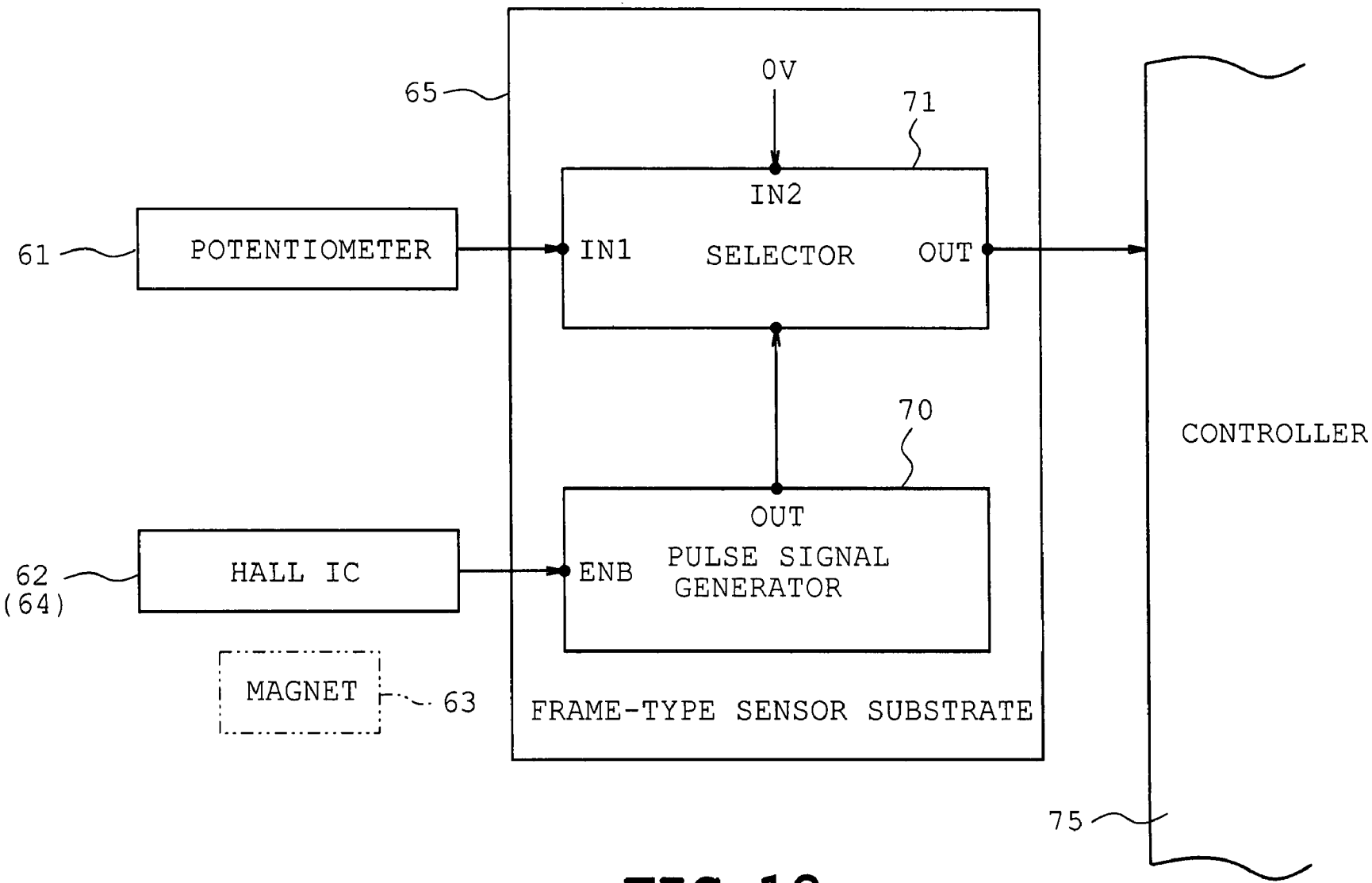
FIG. 12 is a block diagram of a control system for embroidery frame type detection.

Referring to FIG. 12, frame-type sensor substrate 65 is provided with a pulse signal generator 70 and a selector 71. Pulse signal generator 70 has an ENB terminal for receiving an enable signal from Hall IC 62, and an OUT terminal for outputting a select signal to selector 71.

Selector 71 has a SEL terminal for receiving a select signal outputted from OUT terminal of pulse signal generator 70, an IN1 terminal for receiving input of a constant signal outputted from potentiometer 61, an IN2 terminal for receiving input of 0V, and an OUT terminal for outputting frame-type determination signal selected by the select signal based on either of the voltages applied to IN1 terminal or IN2 terminal.

In cases where magnet 63 is not sensed by Hall IC 62, (magnet 63 does not approach the proximity of Hall IC 62), meaning that magnet 63 is not embedded inside retainer 34*d* as is the case for frame types A, B, C, and D; Hall IC 62 produces a detection signal "L" signal to be delivered to ENB terminal. In cases where magnet 63 is sensed by Hall IC 62, (magnet 63 has approached the proximity of Hall IC 62), meaning that magnet 63 is embedded inside retainer 34*d* as is the case for frame types E, F, G, and H; Hall IC 62 produces a detection signal "H" signal to be delivered to ENB terminal.

Referring now to FIG. 14, pulse signal generator 70, when receiving the L signal at its ENB terminal, outputs the L signal to its OUT terminal, whereas when receiving the H level signal at its ENB terminal, outputs a pulse signal (period t=100 msec) alternately switching between the L signal and the H signal at predetermined time interval to its OUT terminal. Thus, as shown in FIG. 15, selector 71, when receiving the L signal at its SEL terminal, outputs a constant signal being delivered to IN1 terminal from potentiometer 61 to controller 75 from OUT terminal; whereas when receiving the H signal at its SEL terminal, outputs the 0V signal being delivered to IN2 terminal to controller 75 from OUT terminal.

Figure 18:
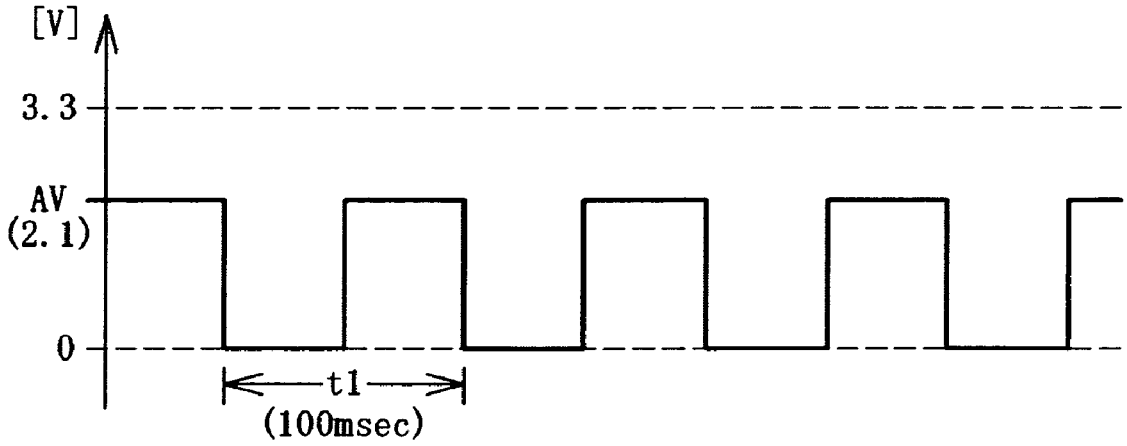
FIG. 18 shows a waveform of a pulse signal (t=100 msec) having an analog voltage.

Selector 71, when receiving the L signal at its SEL terminal, outputs a constant signal having an analog voltage AV to controller 75 from its OUT terminal, whereas when receiving the H signal at its SEL terminal, outputs a frame-type determination signal configured by a pulsed periodic signal (period t=100 msec) with an of "H" level set at analog voltage AV and "L" level set at 0V from OUT terminal to controller 75 as shown in FIG. 18.

Next, a description will be given on a control system of embroidery sewing machine M with reference to the block diagram shown in FIG. 13.

Controller 75 controlling embroidery sewing machine M is configured by a microcomputer comprising a CPU 76, a ROM 77, a RAM 78, and an electrically programmable flash memory (F/M) 79. Controller 75 establishes connections with a start/stop switch 80, a timing signal generator 81 that detects rotational position of a sewing machine main shaft (not shown), frame-type sensor substrate 65, drive circuits 85, 86, 87, 88, and 89 for sewing machine motor 23, needle-bar swing motor 22, thread-cut motor 27 for driving the thread cutter, X-axis drive motor 18 for moving the embroidery frame (cylindrical frame 38) in two orthogonal directions, and Y-axis drive motor 17.

ROM 77 pre-stores a drive control program for controlling motors 17, 18, 22, 23, and 27 for execution of embroidery sewing, a plurality types of sewing data, and a control program for a later described frame-type determination control which is a specific feature of the present disclosure. RAM 78 allocates sewing data memory for storing sewing data for use in sewing operations and other types of memory as required.

Flash memory 79 includes a table memory 79*a* shown in FIG. 16, that pre-stores data populated in frame-type determination table for determining the frame type of the attached cylindrical frame 38 based on incoming frame-type determination signal from frame-type sensor substrate 65. That is, controller 75 stores mapping of frame types (A to D) to frame types (E to H) to magnitudes of analog voltages AV namely 0.7V, 1.4V, 2.1V, and 2.8V, where frame types (A to D) are identified when receiving constant signals of analog voltages AV (0.7V, 1.4V, 2.1V, and 2.8V) and frame types (E to H) are identified when receiving pulse signals having analog voltages AV set to "H" level and 0V set to "L" level.

Figure 19:
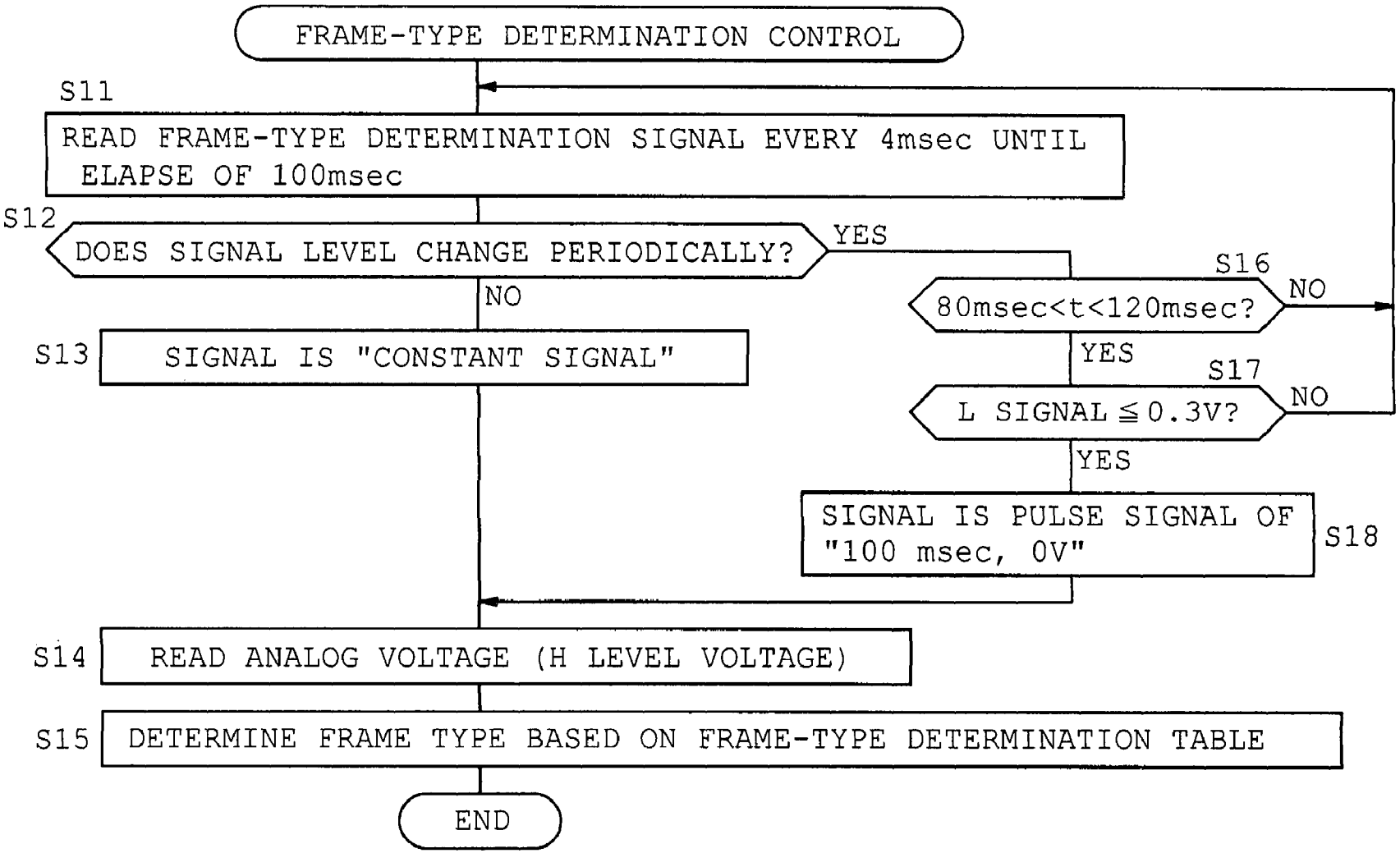
FIG. 19 is a flowchart of a frame-type determination control.
Figure 20:
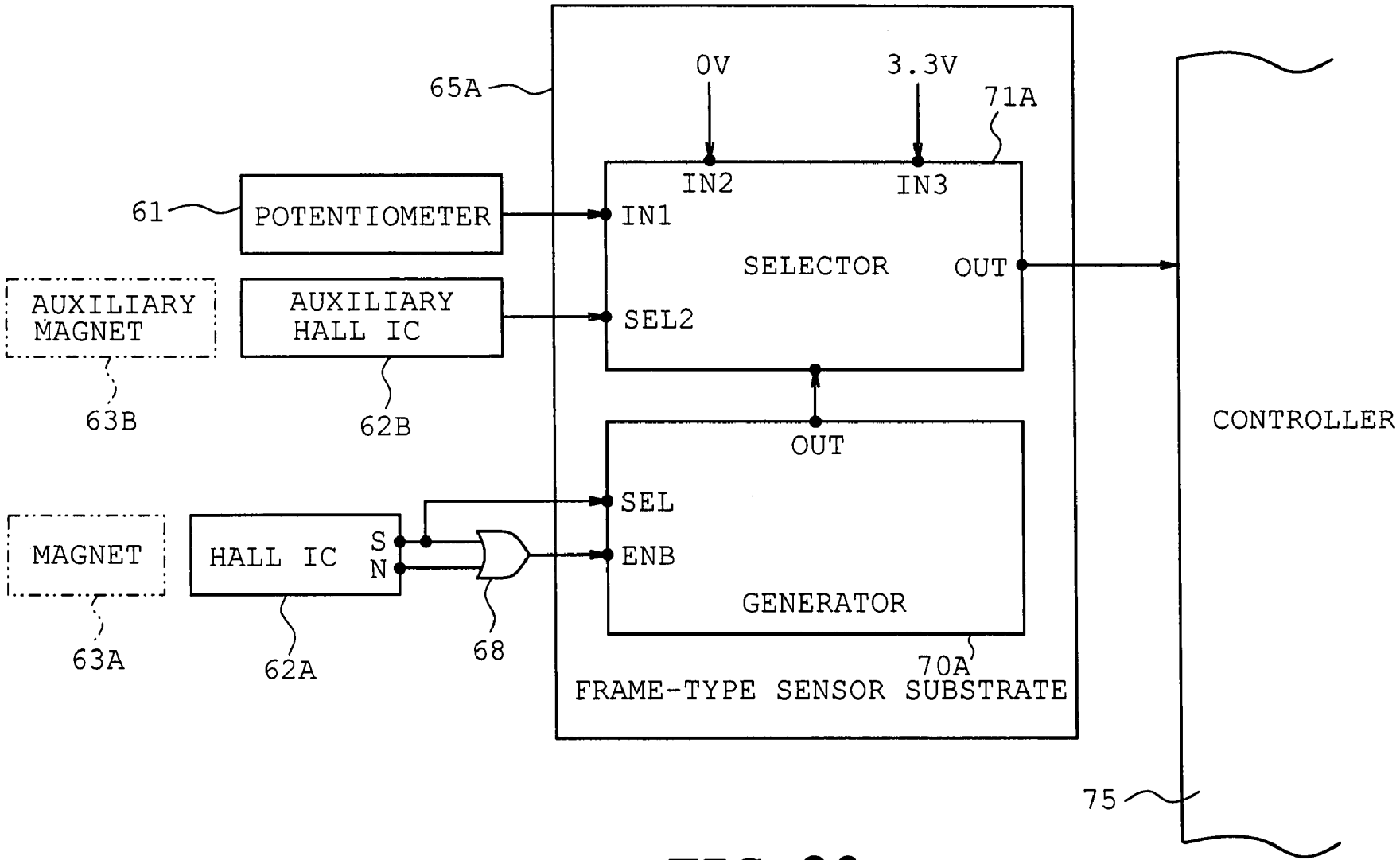
FIG. 20 corresponds to FIG. 12 and illustrates a second exemplary embodiment of the present disclosure.
Figure 25:
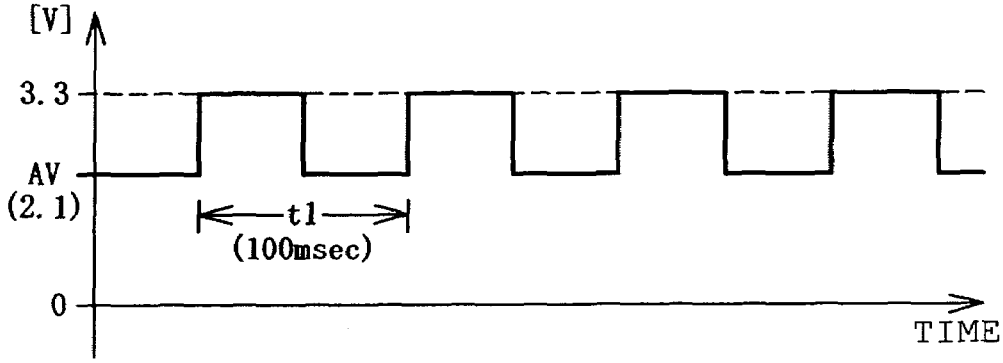
FIG. 25 shows a waveform of the pulse signal (t=100 msec) having analog voltage.
Figure 26:
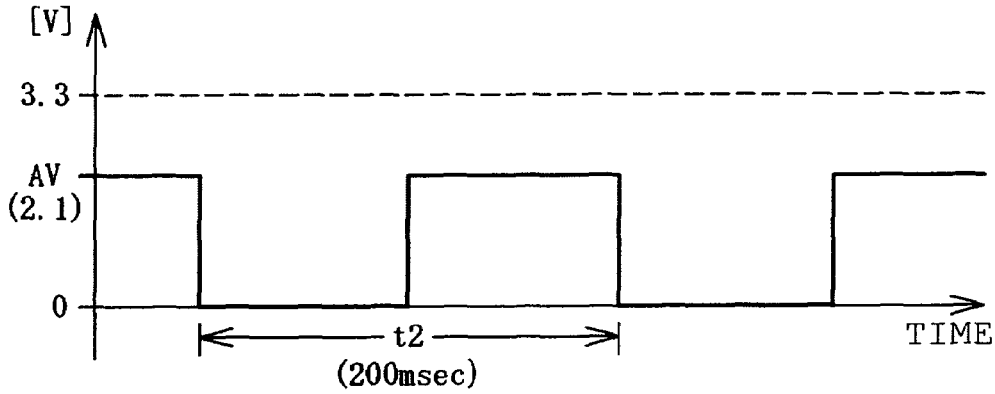
FIG. 26 shows a waveform of the pulse signal (t=200 msec) having analog voltage.
Figure 27:
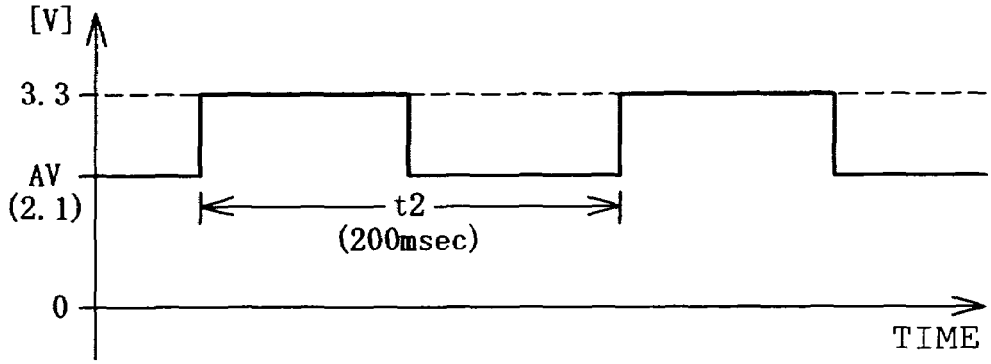
FIG. 27 shows a waveform of the pulse signal (t=200 msec) having analog voltage.

Next, the frame-type determination control executed by controller 75 of multi-needle sewing machine M will be described based on the flowchart indicated in FIG. 19. Symbols Si (i=11, 12, 13 . . . ) indicate each step of the control flow.

Controller 75 starts the frame-type determination control when power is delivered to embroidery sewing machine M. First, controller 75 reads frame-type determination signal outputted from frame-type sensor substrate 65 at 4 msec time intervals until elapse of approximately 100 msec in order to determine whether the input signal is a "constant signal" or a "pulse signal (periodic signal)" (S11).

Then, based on the frame-type determination signal read, if controller 75 detects no periodic change in the signal level (S12: No), the input signal is determined as a "constant signal" (S13) and analog voltage AV of the constant signal is read (S14) Then controller 75, then, accesses the frame-type determination table shown in FIG. 16 to determine the "frame type" (S15) mapped with "constant signal" obtained at S13 of "analog voltage AV" obtained at step S14, and thereafter terminates the control (END).

In contrast, based on the frame-type determination signal read, if controller 75 detects periodic change in the signal level (S12: Yes), and period t of the input signal is longer than 80 msec and shorter than 120 msec (S16: Yes) with its L signal being equal to or less than 0.3V (S17: Yes), the input signal is determined as a pulse signal with period t of "100 msec" and the L signal of 0V (S18). Then, controller 75 reads the "H" level voltage of the H signal (S14), and determines the "frame type" at step S15.

In case period t is equal to or shorter than 80 msec, or equal to or longer than 120 msec (S16: No), or the L signal is greater than 0.3V (S17: No), controller 75 makes a determination that the frame-type determination signal is affected by noise and returns to S11.

For example, as shown in FIG. 11A, when cylindrical frame 38 of frame type B without magnet 63 is attached to carriage 10, the L signal is delivered to ENB terminal of pulse signal generator 70 from Hall IC 62. Pulse signal generator 70 responsively outputs the L signal from its OUT terminal. Selector 71 receives the L signal at its SEL terminal, based upon which a constant signal having analog voltage of "1.4V" delivered to IN1 terminal from potentiometer 61 is outputted from OUT terminal to controller 75.

Then, controller 75 accesses the frame-type determination table to determine "frame type B" from the combination of analog voltage "1.4V" and "constant signal". In contrast, when cylindrical frame 38 of frame type F provided with magnet 63 is attached to carriage 10, the H signal is delivered to ENB terminal of pulse signal generator 70 from Hall IC 62. Pulse signal generator 70 responsively outputs a pulse signal from its OUT terminal. Selector 71 in turn outputs a pulse signal alternating between 0V and analog voltage "1.4V" at 50 msec intervals to controller 75. Controller 75 accesses the frame-type determination table to determine "frame type F" from the combination of analog voltage "1.4V" and "pulse signal".

As described above, by sensing the difference in the level of the constant signal outputted from frame-type sensor substrate 65, controller 75 is capable of distinguishing the frame types of cylindrical frame 38 even with a constant signal. In case a periodic signal, being converted from a constant signal, is outputted from frame-type sensor substrate 65, controller 75 is capable of distinguishing the frame type of cylindrical frame 38 by the period and the "H" level voltage.

Since potentiometer 61, Hall IC 62, and frame-type sensor substrate 65 are provided at carriage 10, only a single wiring code is required for outputting a constant signal or a periodic signal from frame-type sensor substrate 65 to controller 75 of sewing machine M. Thus, wiring between carriage 10 and controller 75 can be minimized to obtain a simple and low cost configuration.

Hall IC 62 is configured by a magnetic sensor that detects non-contact magnetism generated from magnet 63 serving as detection subject provided at cylindrical frame 38. Thus, the frame types of cylindrical frame 38 can be distinguished with accuracy even when cylindrical frame 38 is attached at different positioning relative to carriage 10.

Unlike optical sensors, Hall IC 62, being configured as magnetic sensor, does not suffer reduction in detection accuracy by lint and dust produced by the treated workpiece, thus providing sustainable stability in its detection accuracy.

Frame-type sensor substrate 65, provided with pulse signal generator 70 for converting a constant signal to a periodic signal achieves simple and reliable constant-to-periodic signal conversion.

By simply providing Hall IC 62 and frame-type sensor substrate 65 in addition to the conventional configuration, a considerable increase can be achieved on the number of distinguishable frame types of cylindrical frames 38.

Next, a second exemplary embodiment of the present disclosure will be described with reference to FIGS. 20 to 28.

In the present exemplary embodiment, the interior configuration of frame-type sensor substrate 65A is partially modified. More specifically, a pulse signal generator 70A is provided with an ENB terminal, a SEL terminal, and an OUT terminal; whereas a selector 71A is provided with a SEL 1 terminal, a SEL 2 terminal, and terminals IN1 to IN3. Further, an auxiliary Hall IC 62B is additionally provided to deliver an "L signal" to SEL 2 terminal when approach of auxiliary magnet 63B is not detected, whereas "H signal" is delivered to SEL 2 terminal when approach of auxiliary magnet 63B is detected.

As can be seen in FIG. 21, when magnet 63A does not approach Hall IC 62A, "L signal" is outputted from S and N terminals of Hall IC 62A, respectively. However, when the N-pole of magnet 63A approaches Hall IC 62A, the L signal is outputted from S terminal whereas the H signal is outputted from N terminal; and when the S-pole of magnet 63A approaches Hall IC 62A, the H signal is outputted from S terminal whereas the L signal is outputted from N terminal.

As shown in FIG. 22, pulse signal generator 70A, when receiving the L signal at its ENB terminal from a gate circuit 68 and the L signal to its SEL terminal, outputs the L signal to its OUT terminal. On the other hand, pulse signal generator 70A, when receiving the H signal at its ENB terminal from gate circuit 68 and the L signal to its SEL terminal, outputs pulse signal (period t=100 msec) alternately switching between the L signal and the H signal at predetermined time interval to its OUT terminal. Further, pulse signal generator 70A, when receiving the H signal at its ENB terminal from gate circuit 68 and the H signal to its SEL terminal, outputs pulse signal (period t=200 msec) alternately switching between the L signal and the H signal at predetermined time interval to its OUT terminal.

Thus, selector 71A, as shown in FIG. 23, outputs various frame-type determination signals from its OUT terminal. More specifically, selector 71A, when receiving the L signal to its SEL 2 terminal and the L signal to its SEL 1 terminal, outputs a constant signal delivered to IN1 terminal to controller 75 from OUT terminal. On the other hand, selector 71A, when receiving the L signal to its SEL 2 terminal and H signal to its SEL 1 terminal, outputs 0V delivered to IN2 terminal to controller 75 from OUT terminal.

Further, selector 71A, when receiving H signal to SEL 2 terminal and L signal to SEL 1 terminal, outputs constant signal delivered to IN1 terminal to controller 75 from OUT terminal. On the other hand, selector 71A, when receiving the H signal to SEL 2 terminal and the H signal to SEL 1 terminal, outputs 3.3V signal delivered to IN3 terminal to controller 75 from OUT terminal.

Figure 17:
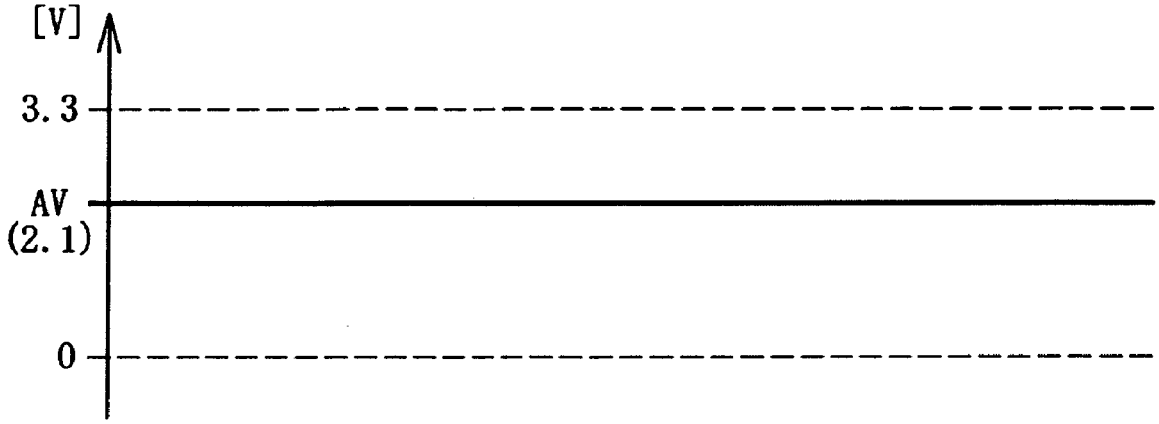
FIG. 17 shows a waveform of a constant signal having an analog voltage.

In other words, selector 71A, when receiving the L signal to its SEL 1 and SEL 2 terminals, outputs a constant signal having an analog voltage AV to controller 75 from OUT terminal, as shown in FIG. 17; whereas when receiving the L signal to its SEL 1 terminal, sets analog voltage AV to "H level", and when receiving the H signal to its SEL 1 terminal and the L signal to its SEL 2 terminal, outputs a pulse signal reduced to 0V having period t of 100 msec or 200 msec depending upon the orientation of magnet 63.

Further, selector 71A, when receiving the L signal to its SEL 1 terminal, sets analog voltage AV to "H" level, and when receiving the H signal to SEL 1 terminal and the H signal to SEL 2 terminal, outputs a pulse signal increased to 3.3V having period t of 100 msec or 200 msec depending upon the orientation of magnet 63.

Flash memory 79, as shown in FIG. 24, is provided with a table memory that pre-stores data populated in the frame-type determining table for determining the frame type of cylindrical frame 38 attached to carriage 10 based on the incoming frame-type determination signal.

That is, controller 75 determines the frame type of cylindrical frame 38 attached to carriage 10 based on pre-stored information. More specifically, incoming constant signals having analog voltage AV (0.7V, 1.4V, 2.1V, 2.8V) is mapped with frame types "A to D"; whereas incoming pulse signals having analog voltage AV set to "H" level and being periodically (period t1=100 msec or t2=200 msec) reduced to 0V (refer to FIGS. 18 and 26), and incoming pulse signals having analog voltage AV set to "H" level and being periodically (period t1=100 msec or t2=200 msec) increased to 3.3V (refer to FIGS. 25 and 27) are mapped with frame types E to T.

Figure 28:
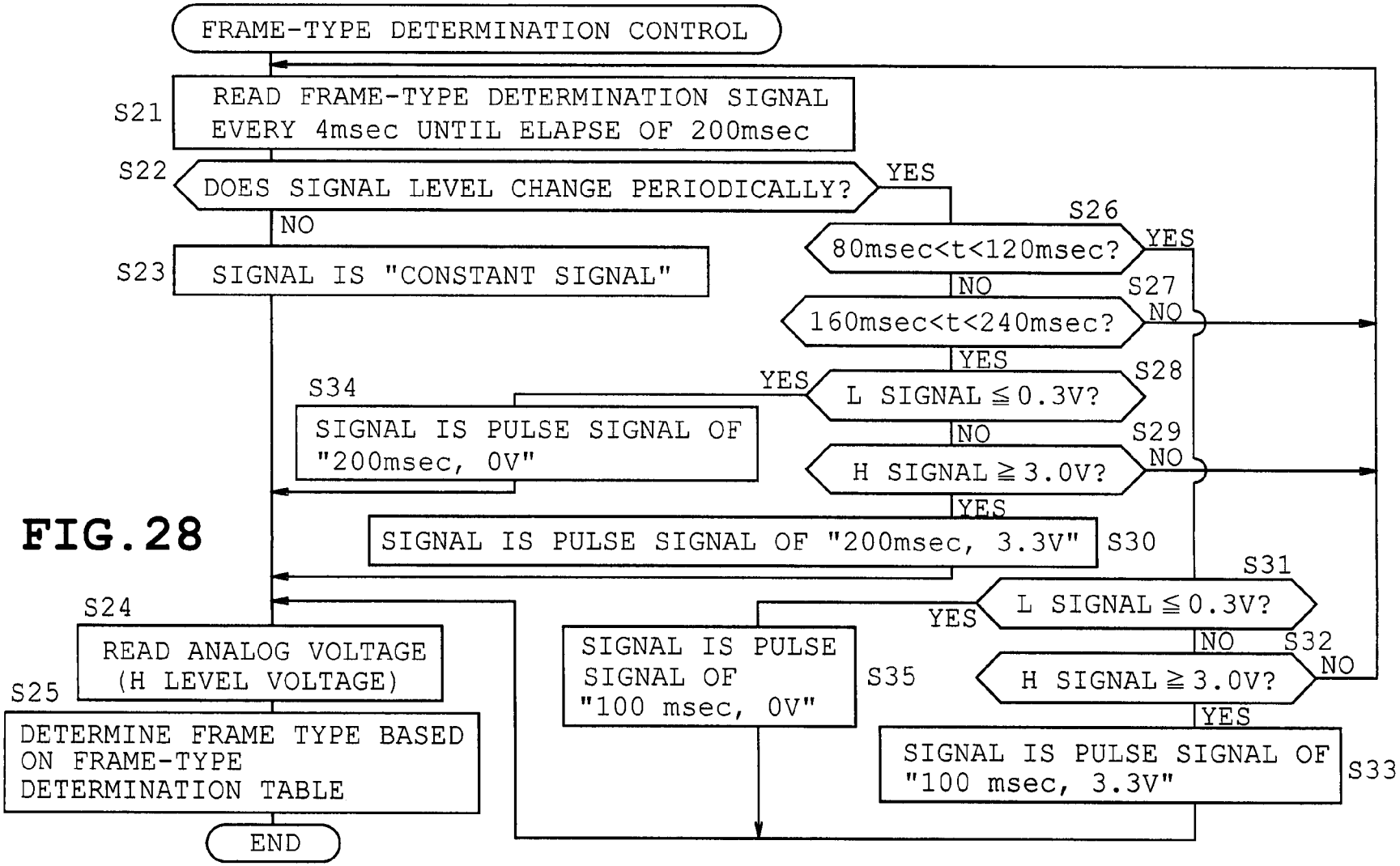
FIG. 28 is a flowchart of the frame-type determination control.

Next, the frame-type determination control executed by controller 75 of multi-needle embroidery sewing machine M will be described based on flowchart indicated in FIG. 28.

Controller 75 starts the frame-type determination control when power is delivered to embroidery sewing machine M. First, controller 75 reads the frame-type determination signal outputted from frame-type sensor substrate 65 in 4 msec time intervals until elapse of approximately 200 msec in order to determine whether the input signal is a "constant signal" or a "pulse signal (S21).

Then, based on the frame-type determination signal read, if controller 75 detects no periodic change in the signal level (S22: No), the input signal is determined as a "constant signal" (S23) and the analog voltage AV of the constant signal is read (S24). Then, controller 75 accesses the frame-type determination table shown in FIG. 24 to determine the "frame type" (S25) mapped to "constant signal" obtained at S23 and the "analog voltage AV" obtained at S24, and thereafter terminates the control (END).

If controller 75 detects periodic change in the signal level (S22: Yes) of the frame-type determination signal read, and period t of the input signal is longer than 80 msec and shorter than 120 msec (S26: Yes) with its L signal being equal to or less than 0.3V (S31: Yes), the input signal is determined as a pulse signal having period t of "100 msec" and the L signal of 0V (S35). Then, controller 75 reads the "H" level voltage of the H signal (S24), and determines the "frame type" at step S25.

In case the signal level of the frame-type determination signal read changes periodically (S22: Yes), period t is longer than 80 msec, and shorter than 120 msec (S26: Yes), and the H signal is equal to or greater than 3.0V (S31: No, S32: Yes), controller 75 determines the input signal as a pulse signal having period t of "100 msec" and the H signal of "3.3V" (S33). Then, controller 75 reads the "H" level voltage of the H signal (S24) and determines the "frame type" at step S25.

In case the signal level of the frame-type determination signal read changes periodically (S22: Yes) and period t is longer than 160 msec, and shorter than 240 msec (S26: No, S27: Yes), and the L signal is equal to or less than 0.3V (S28: Yes), the input signal is determined as a pulse signal having period t of "200 msec" and the H signal of "0V" (S34). Then, controller 75 reads the "H" level voltage of the H signal (S24) and determines the "frame type" at S25.

In case the signal level of the frame-type determination signal read changes periodically (S22: Yes) and period t is longer than 160 msec, and shorter than 240 msec (S26: No, S27: Yes), and the H signal is equal to or greater than 3.0V (S28: No, S29: Yes), the input signal is determined as a pulse signal having period t of "200 msec" and the H signal of "3.3V" (S30). Then, controller 75 reads the "H" level voltage of the H signal (S24) and determines the "frame type" at S25.

In case period t is equal to or shorter than 160 msec, or equal to or longer than 240 msec (S27: No) or the H signal is less than 3.0V, (S29: No, S32: No), controller 75 makes a determination that the frame-type determination signal is affected by noise and repeats S21.

As described above, the pulse signal (periodic signal) has at least either of its period and signal voltage modified. Thus the frame type of cylindrical frame 38 can be determined from increased number of frame types.

Further, the frame type of cylindrical frame 38 can be determined from increased number of frame types by also considering the different voltage levels namely, the "H" level and the "L" level in addition to period modification of the periodic signals.

Though the above described exemplary embodiments have been described based on cylindrical frames 38, similar frame type determination can be made with flat frames by merely providing flat frames with magnets 63 and without magnets 63 for attachment with the carriage 10 attachment.

The types of analog voltage AV of constant signals are not limited to four types (0.7V, 1.4V, 2.1V and 2.8V), but may be modified according to factors such as characteristics of voltage output of potentiometer 61 and number of embroidery frame types.

Embroidery frame detection mechanism 13 is configured by potentiometer 61 and the magnet sensor comprising Hall IC 62. However, potentiometer 61 may be replaced by elements such as an encoder. Further, the magnet sensor may be replaced by elements such as a proximity switch.

When employing auxiliary Hall IC 62B, arrangements may be made to detect polarity of the auxiliary magnet.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroiderable sewing machine, comprising:

a plurality types of embroidery frames that hold a workpiece cloth to be embroidered;

a carriage allowing selective attachment and detachment of the embroidery frames;

a transfer mechanism that transfers the carriage independently in two orthogonal directions;

a first detector that outputs a constant signal corresponding to the type of embroidery frame attached to the carriage;

a second detector capable of outputting a detection signal based on presence and absence of a detection subject provided at the embroidery frame; and a signal converter that converts the constant signal outputted from the first detector into a periodic signal based on the detection signal outputted from the second detector.

2. The sewing machine of claim 1, wherein the first detector, the second detector, and the signal converter are provided at the carriage.

3. The sewing machine of claim 1, wherein the detection subject comprises a magnet and the second detector comprises a magnetic sensor that detects magnetism produced by the magnet.

4. The sewing machine of claim 1, wherein the signal converter includes a pulse signal generator that converts the constant signal into the periodic signal.

5. The sewing machine of claim 1, wherein the periodic signal is a signal with at least either of oscillation period and signal voltage being modified.

* * * * *